US011031022B2

(12) United States Patent
Disch et al.

(10) Patent No.: US 11,031,022 B2
(45) **Date of Patent: *Jun. 8, 2021**

(54) NOISE FILLING CONCEPT

(71) Applicant: Fraunhofer-Gesellschaft zur Foerderung der angewandten Forschung e.V., Munich (DE)

(72) Inventors: Sascha Disch, Fuerth (DE); Marc Gayer, Erlangen (DE); Christian Helmrich, Erlangen (DE); Goran Markovic, Nuremberg (DE); Maria Luis Valero, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/523,588

(22) Filed: Jul. 26, 2019

(65) Prior Publication Data

US 2019/0348053 A1 Nov. 14, 2019

Related U.S. Application Data

(63) Continuation of application No. 15/698,442, filed on Sep. 7, 2017, now Pat. No. 10,410,642, which is a continuation of application No. 14/812,354, filed on Jul. 29, 2015, now Pat. No. 9,792,920, which is a continuation of application No. PCT/EP2014/051630, filed on Jan. 28, 2014.

(60) Provisional application No. 61/758,209, filed on Jan. 29, 2013.

(51) Int. Cl.

| | |
|---|---|
| ***G10L 19/028*** | (2013.01) |
| ***G10L 19/012*** | (2013.01) |
| ***G10L 19/04*** | (2013.01) |

(52) U.S. Cl.
CPC ..... *G10L 19/012* (2013.01); *G10L 19/028* (2013.01); *G10L 19/04* (2013.01)

(58) Field of Classification Search
USPC ..... 704/500, 501, 502
See application file for complete search history.

(56) References Cited

U.S. PATENT DOCUMENTS

| | | | |
|---|---|---|---|
| 5,040,217 | A | 8/1991 | Brandenburg et al. |
| 5,692,102 | A | 11/1997 | Pan |
| 6,167,133 | A | 12/2000 | Caceres et al. |
| 8,484,038 | B2 | 7/2013 | Bessette et al. |

(Continued)

FOREIGN PATENT DOCUMENTS

| | | | |
|---|---|---|---|
| CA | 2871372 | A1 | 1/2010 |
| CA | 2840732 | A1 | 1/2013 |

(Continued)

OTHER PUBLICATIONS

Chen, Juin-Hwey et al., "Adaptive postfiltering for quality enhancement of coded speech", IEEE Transactions on Speech and Audio Processing, vol. 3, No. 1, XP002235479, Jan. 1995, pp. 59-71.

*Primary Examiner* — Qi Han
(74) *Attorney, Agent, or Firm* — Michael A. Glenn; Perkins Coie LLP

(57) ABSTRACT

Noise filling of a spectrum of an audio signal is improved in quality with respect to the noise filled spectrum so that the reproduction of the noise filled audio signal is less annoying, by performing the noise filling in a manner dependent on a tonality of the audio signal.

13 Claims, 22 Drawing Sheets

(56) References Cited

U.S. PATENT DOCUMENTS

| | | | |
|---|---|---|---|
| 8,527,265 | B2 | 9/2013 | Reznik et al. |
| 8,577,675 | B2 | 11/2013 | Jelinek et al. |
| 8,983,851 | B2 | 3/2015 | Rettelbach et al. |
| 9,349,380 | B2 | 5/2016 | Choo |
| 2003/0233234 | A1 | 12/2003 | Truman et al. |
| 2003/0233236 | A1 | 12/2003 | Davidson et al. |
| 2005/0143989 | A1 | 6/2005 | Jelinek |
| 2006/0217975 | A1 | 9/2006 | Sung et al. |
| 2007/0162277 | A1 | 7/2007 | Kurniawati et al. |
| 2008/0097749 | A1 | 4/2008 | Xie et al. |
| 2009/0234644 | A1 | 9/2009 | Reznik et al. |
| 2010/0241437 | A1 | 9/2010 | Taleb et al. |
| 2011/0145003 | A1 | 6/2011 | Bessette |
| 2011/0173012 | A1 | 7/2011 | Rettelbach et al. |
| 2012/0046955 | A1 | 2/2012 | Rajendran et al. |
| 2012/0245947 | A1 | 9/2012 | Neuendorf et al. |
| 2012/0271644 | A1 | 10/2012 | Bessette et al. |
| 2015/0332686 | A1 | 11/2015 | Disch et al. |

FOREIGN PATENT DOCUMENTS

| | | | |
|---|---|---|---|
| CN | 101030373 | A | 9/2007 |
| CN | 101809657 | A | 8/2010 |
| CN | 102089806 | A | 6/2011 |
| CN | 102150201 | A | 8/2011 |
| CN | 102194457 | A | 9/2011 |
| CN | 102884574 | A | 1/2013 |
| EP | 2077550 | A1 | 7/2009 |
| JP | 2005530205 | A | 10/2005 |
| JP | 2013508765 | A | 3/2013 |
| JP | 2014523548 | A | 9/2014 |
| KR | 1020110039245 | A | 4/2011 |
| RU | 2405217 | C2 | 11/2010 |
| RU | 2461898 | C2 | 9/2012 |
| TW | 200828268 | A | 7/2008 |
| TW | 200912897 | A | 3/2009 |
| TW | 201137860 | A | 11/2011 |
| TW | 201142827 | A | 12/2011 |
| WO | 2009056027 | A1 | 5/2009 |
| WO | 2010003556 | A1 | 1/2010 |
| WO | 2010040522 | A2 | 4/2010 |
| WO | 2011044700 | A1 | 4/2011 |
| WO | 2012016128 | A2 | 2/2012 |
| WO | 2012024379 | A2 | 2/2012 |
| WO | 2012016128 | A3 | 4/2012 |
| WO | 2012046685 | A1 | 4/2012 |
| WO | 2012121638 | A1 | 9/2012 |

noise filling for hole sizes from 1 to 12, transition width 4 noise filling for hole sizes from 1 to 12, transition width 8 noise filling for hole sizes from 1 to 12, transition width 12 noise filling for hole sizes 28, transition width 12

NOISE FILLING CONCEPT

CROSS-REFERENCE TO RELATED APPLICATIONS

This application is a continuation of copending U.S. application Ser. No. 15/698,442 filed Sep. 7, 2017, which is continuation of U.S. application Ser. No. 14/812,354, filed Jul. 29, 2015, which is a continuation of International Application No. PCT/EP2014/051630, filed Jan. 28, 2014, which claims priority from US Application No. 61/758,209, filed Jan. 29, 2013, which are each incorporated herein in its entirety by this reference thereto.

BACKGROUND OF THE INVENTION

The present application is concerned with audio coding, and especially with noise filling in connection with audio coding.

In transform coding it is often recognized (compare [1], [2], [3]) that quantizing parts of a spectrum to zeros leads to a perceptual degradation. Such parts quantized to zero are called spectrum holes. A solution for this problem presented in [1], [2], [3] and [4] is to replace zero-quantized spectral lines with noise. Sometimes, the insertion of noise is avoided below a certain frequency. The starting frequency for noise filling is fixed, but different between the known technology.

Sometimes, FDNS (Frequency Domain Noise Shaping) is used for shaping the spectrum (including the inserted noise) and for the control of the quantization noise, as in USAC (compare [4]). FDNS is performed using the magnitude response of the LPC filter. The LPC filter coefficients are calculated using the pre-emphasized input signal.

It was noted in [1] that adding noise in the immediate neighborhood of a tonal component leads to a degradation, and accordingly, just as in [5] only long runs of zeros are filled with noise to avoid concealing non-zero quantized values by the injected surrounding noise.

In [3] it is noted that there is a problem of a compromise between the granularity of the noise filling and the size of the necessitated side information. In [1], [2], [3] and [5] one noise filling parameter per complete spectrum is transmitted. The inserted noise is spectrally shaped using LPC as in [2] or using scale factors as in [3]. It is described in [3] how to adapt scale factors to a noise filling with one noise filling level for the whole spectrum. In [3], the scale factors for bands that are completely quantized to zero are modified to avoid spectral holes and to have a correct noise level.

Even though the solutions in [1] and [5] avoid a degradation of tonal components in that they suggest not filling small spectrum holes, there is still a need to further improve the quality of an audio signal coded using noise filling, especially at very low bit-rates.

SUMMARY

An embodiment may have an apparatus configured to perform noise filling on a spectrum of an audio signal in a manner dependent on a tonality of the audio signal, wherein the apparatus is configured to dequantize the spectrum, as derived after the noise-filling, using a spectrally varying and signal-adaptive quantization step size controlled via a linear prediction spectral envelope signaled via linear prediction coefficients in a data stream into which the spectrum is coded, or scale factors relating to scale factor bands, signaled in the data stream into which the spectrum is coded, wherein the apparatus is configured to fill a contiguous spectral zero-portion of the audio signal's spectrum with noise spectrally shaped using: a function assuming a maximum in an inner of the contiguous spectral zero-portion, and including outwardly falling edges an absolute slope of which negatively depends on the tonality, or a function assuming a maximum in an inner of the contiguous spectral zero-portion, and including outwardly falling edges a spectral width of which positively depends on the tonality, or a constant or unimodal function an integral of which—normalized to an integral of 1—over outer quarters of the contiguous spectral zero-portion negatively depends on the tonality.

Another embodiment may have an apparatus configured to perform noise filling on a spectrum of an audio signal in a manner dependent on a tonality of the audio signal, wherein the apparatus is configured to dequantize the spectrum, as derived after the noise-filling, using a spectrally varying and signal-adaptive quantization step size controlled via a linear prediction spectral envelope signaled via linear prediction coefficients in a data stream into which the spectrum is coded, or scale factors relating to scale factor bands, signaled in the data stream into which the spectrum is coded, identify contiguous spectral zero-portions of the audio signal's spectrum and to apply the noise filling onto the contiguous spectral zero-portions identified, and respectively fill the contiguous spectral zero-portions of the audio signal's spectrum with noise spectrally shaped with a function set dependent on a respective contiguous spectral zero-portion's width so that the function is confined to the respective contiguous spectral zero-portion, and dependent on the tonality of the audio signal so that, if the tonality of the audio signal increases, the function gets more compact in the inner of the respective contiguous spectral zero-portion and distanced from the respective contiguous spectral zero-portion's outer edges.

Another embodiment may have an audio decoder supporting noise filling including an inventive apparatus.

According to another embodiment, a perceptual transform audio decoder may have: an inventive apparatus configured to perform noise filling on a spectrum of an audio signal; and a frequency domain noise shaper configured to subject the noise filled spectrum to spectral shaping using a spectral perceptual weighting function.

Another embodiment may have an audio encoder supporting noise filling including an inventive apparatus, the encoder being configured to use a spectrum filled with noise by the apparatus, for analysis-by-synthesis.

Another embodiment may have an audio encoder supporting noise filling, configured to quantize and code a spectrum of an audio signal into a data stream and set and code into the data stream, a spectrally global noise filling level for performing noise filling on the spectrum of the audio signal, in a manner dependent on a tonality of the audio signal, wherein the encoder is configured to, in setting and coding the spectrally global noise filling level, measure of a level of the audio signal within contiguous spectral zero-portions of the spectrum, spectrally shaped dependent on the tonality of the audio signal, wherein the contiguous spectral zero-portions of the audio signal's spectrum are spectrally shaped using a function assuming a maximum in an inner of the contiguous spectral zero-portion, and including outwardly falling edges an absolute slope of which negatively depends on the tonality, or a function assuming a maximum in an inner of the contiguous spectral zero-portion, and including outwardly falling edges a spectral width of which positively depends on the tonality, or a constant or unimodal function an integral of which—normalized to an integral of 1—over outer quarters of the contiguous spectral zero-portion negatively depends on the tonality.

Another embodiment may have a method including performing noise filling on a spectrum of an audio signal in a manner dependent on a tonality of the audio signal, wherein the method includes dequantizing the spectrum, as derived after the noise-filling, using a spectrally varying and signal-adaptive quantization step size controlled via a linear prediction spectral envelope signaled via linear prediction coefficients in a data stream into which the spectrum is coded, or scale factors relating to scale factor bands, signaled in the data stream into which the spectrum is coded, wherein the method includes filling a contiguous spectral zero-portion of the audio signal's spectrum with noise spectrally shaped using: a function assuming a maximum in an inner of the contiguous spectral zero-portion, and including outwardly falling edges an absolute slope of which negatively depends on the tonality, or a function assuming a maximum in an inner of the contiguous spectral zero-portion, and including outwardly falling edges a spectral width of which positively depends on the tonality, or a constant or unimodal function an integral of which—normalized to an integral of 1—over outer quarters of the contiguous spectral zero-portion negatively depends on the tonality.

Another embodiment may have a method for audio encoding supporting noise filling, the method including quantizing and coding a spectrum of an audio signal into a data stream and setting and coding into the data stream, a spectrally global noise filling level for performing noise filling on the spectrum of the audio signal, in a manner dependent on a tonality of the audio signal, wherein the setting and coding the spectrally global noise filling level includes measuring of a level of the audio signal within contiguous spectral zero-portions of the spectrum, spectrally shaped dependent on the tonality of the audio signal, wherein the contiguous spectral zero-portions of the audio signal's spectrum are spectrally shaped using: a function assuming a maximum in an inner of the contiguous spectral zero-portion, and including outwardly falling edges an absolute slope of which negatively depends on the tonality, or a function assuming a maximum in an inner of the contiguous spectral zero-portion, and including outwardly falling edges a spectral width of which positively depends on the tonality, or a constant or unimodal function an integral of which—normalized to an integral of 1—over outer quarters of the contiguous spectral zero-portion negatively depends on the tonality.

Another embodiment may have a computer program including a program code for performing, when running on a computer, a method including performing noise filling on a spectrum of an audio signal in a manner dependent on a tonality of the audio signal, wherein the method includes dequantizing the spectrum, as derived after the noise-filling, using a spectrally varying and signal-adaptive quantization step size controlled via a linear prediction spectral envelope signaled via linear prediction coefficients in a data stream into which the spectrum is coded, or scale factors relating to scale factor bands, signaled in the data stream into which the spectrum is coded, wherein the method includes filling a contiguous spectral zero-portion of the audio signal's spectrum with noise spectrally shaped using: a function assuming a maximum in an inner of the contiguous spectral zero-portion, and including outwardly falling edges an absolute slope of which negatively depends on the tonality, or a function assuming a maximum in an inner of the contiguous spectral zero-portion, and including outwardly falling edges a spectral width of which positively depends on the tonality, or a constant or unimodal function an integral of which—normalized to an integral of 1—over outer quarters of the contiguous spectral zero-portion negatively depends on the tonality, when said computer program is run by a computer.

Another embodiment may have a computer program including a program code for performing, when running on a computer, a method for audio encoding supporting noise filling, the method including quantizing and coding a spectrum of an audio signal into a data stream and setting and coding into the data stream, a spectrally global noise filling level for performing noise filling on the spectrum of the audio signal, in a manner dependent on a tonality of the audio signal, wherein the setting and coding the spectrally global noise filling level includes measuring of a level of the audio signal within contiguous spectral zero-portions of the spectrum, spectrally shaped dependent on the tonality of the audio signal, wherein the contiguous spectral zero-portions of the audio signal's spectrum are spectrally shaped using: a function assuming a maximum in an inner of the contiguous spectral zero-portion, and including outwardly falling edges an absolute slope of which negatively depends on the tonality, or a function assuming a maximum in an inner of the contiguous spectral zero-portion, and including outwardly falling edges a spectral width of which positively depends on the tonality, or a constant or unimodal function an integral of which—normalized to an integral of 1—over outer quarters of the contiguous spectral zero-portion negatively depends on the tonality, when said computer program is run by a computer.

It is a basic finding of the present application that noise filling of a spectrum of an audio signal may be improved in quality with respect to the noise filled spectrum so that the reproduction of the noise filled audio signal is less annoying, by performing the noise filling in a manner dependent on a tonality of the audio signal.

In accordance with an embodiment of the present application, a contiguous spectral zero-portion of the audio signal's spectrum is filled with noise spectrally shaped using a function assuming a maximum in an inner of the contiguous spectral zero-portion, and having outwardly falling edges an absolute slope of which negatively depends on the tonality, i.e. the slope decreases with increasing tonality. Additionally or alternatively, the function used for filling assumes a maximum in an inner of the contiguous spectral zero-portion and has outwardly falling edges, a spectral width of which positively depends on the tonality, i.e. the spectral width increases with increasing tonality. Even further, additionally or alternatively, a constant or unimodal function may be used for filling, an integral of which—normalized to an integral of 1—over outer quarters of the contiguous spectral zero-portion negatively depends on the tonality, i.e. the integral decreases with increasing tonality. By all of these measures, noise filling tends to be less detrimental for tonal parts of the audio signal, however with being nevertheless effective for non-tonal parts of the audio signal in terms of reduction of spectrum holes. In other words, whenever the audio signal has a tonal content, the noise filled into the audio signal's spectrum leaves the tonal peaks of the spectrum unaffected by keeping enough distance therefrom, wherein however the non-tonal character of temporal phases of the audio signal with the audio content as non-tonal is nevertheless met by the noise filling.

In accordance with an embodiment of the present application, contiguous spectral zero-portions of the audio signal's spectrum are identified and the zero-portions identified are filled with noise spectrally shaped with functions so that, for each contiguous spectral-zero portion the respective function is set dependent on a respective contiguous spectral zero-portion's width and a tonality of the audio signal. For the ease of implementation, the dependency may be achieved by a lookup in a look-up table of functions, or the functions may be computed analytically using a mathematical formula depending on the contiguous spectral zero-portion's width and the tonality of the audio signal. In any case, the effort for realizing the dependency is relatively minor compared to the advantages resulting from the dependency. In particular, the dependency may be such that the respective function is set dependent on the contiguous spectral zero-portion's width so that the function is confined to the respective contiguous spectral zero-portion, and dependent on the tonality of the audio signal so that, for a higher tonality of the audio signal, a function's mass becomes more compact in the inner of the respective contiguous spectral zero-portion and distanced from the respective contiguous spectral zero-portion's edges.

In accordance with a further embodiment, the noise spectrally shaped and filled into the contiguous spectral zero-portions is commonly scaled using a spectrally global noise filling level. In particular, the noise is scaled such that an integral over the noise in the contiguous spectral zero-portions or an integral over the functions of the contiguous spectral zero-portions corresponds to, e.g. is equal to, a global noise filling level. Advantageously, a global noise filling level is coded within existing audio codecs anyway so that no additional syntax has to be provided for such audio codecs. That is, the global noise filling level may be explicitly signaled in the data stream into which the audio signal is coded with low effort. In effect, the functions with which the contiguous spectral zero-portion's noise is spectrally shaped may be scaled such that an integral over the noise with which all contiguous spectral zero-portions are filled corresponds to the global noise filling level.

In accordance with an embodiment of the present application, the tonality is derived from a coding parameter using which the audio signal is coded. By this measure, no additional information needs to be transmitted within an existing audio codec. In accordance with specific embodiments, the coding parameter is an LTP (Long-Term Prediction) flag or gain, a TNS (Temporal Noise Shaping) enablement flag or gain and/or a spectrum rearrangement enablement flag.

In accordance with a further embodiment, the performance of the noise filling is confined onto a high-frequency spectral portion, wherein a low-frequency starting position of the high-frequency spectral portion is set corresponding to an explicit signaling in a data stream and to which the audio signal is coded. By this measure, a signal adaptive setting of the lower bound of the high-frequency spectral portion in which the noise filling is performed, is feasible. By this measure, in turn, the audio quality resulting from the noise filling may be increased. The additional side information necessitated, in turn, caused by the explicit signaling, is comparatively small.

In accordance with a further embodiment of the present application, the apparatus is configured to perform the noise filing using a spectral low-pass filter so as to counteract a spectral tilt caused by a pre-emphasis used to code the audio signal's spectrum. By this measure, the noise filling quality is increased even further, since the depth of remaining spectrum holes is further reduced. More generally speaking, noise filling in perceptual transform audio codecs may be improved by, in addition to tonality dependently spectrally shaping the noise within spectrum holes, performing the noise filling with a spectrally global tilt, rather than in a spectrally flat manner. For example, the spectrally global tilt may have a negative slope, i.e. exhibit a decrease from low to high frequencies, in order to at least partially reverse the spectral tilt caused by subjecting the noise filled spectrum to the spectral perceptual weighting function. A positive slope may be imaginable as well, e.g. in cases where the coded spectrum exhibits a high-pass-like character. In particular, spectral perceptual weighting functions typically tend to exhibit an increase from low to high frequencies. Accordingly, noise filled into the spectrum of perceptual transform audio coders in a spectrally flat manner, would end-up in a tilted noise floor in the finally reconstructed spectrum. The inventors of the present application, however, realized that this tilt in the finally reconstructed spectrum negatively affects the audio quality, because it leads to spectral holes remaining in noise-filled parts of the spectrum. Accordingly, inserting the noise with a spectrally global tilt so that the noise level decreases from low to high frequencies at least partially compensates for such a spectral tilt caused by the subsequent shaping of the noise filled spectrum using the spectral perceptual weighting function, thereby improving the audio quality. Depending on the circumstances, a positive slope may be advantageous, e.g. on certain high-pass-like spectra.

In accordance with an embodiment, the slope of the spectrally global tilt is varied responsive to a signaling in the data stream into which the spectrum is coded. The signaling may, for example, explicitly signal the steepness and may be adapted, at the encoding side, to the amount of spectral tilt caused by the spectral perceptual weighting function. For example, the amount of spectral tilt caused by the spectral perceptual weighting function may stem from a pre-emphasis which the audio signal is subject to before applying the LPC analysis thereon.

The noise filling may be used at audio encoding and/or audio decoding side. When used at the audio encoding side, the noise filled spectrum may be used for analysis-by-synthesis purposes.

In accordance with an embodiment, an encoder determines the global noise scaling level by taking the tonality dependency into account.

BRIEF DESCRIPTION OF THE DRAWINGS

Embodiments of the present invention will be detailed subsequently referring to the appended drawings, in which.

DETAILED DESCRIPTION OF THE INVENTION

Wherever in the following description of the figures, equal reference signs are used for the elements shown in these figures, the description brought forward with regard to one element in one figure shall be interpreted as transferrable onto the element in another figure having been referenced using the same reference sign. By this measure, an extensive and repetitive description is avoided as far as possible, thereby concentrating the description of the various embodiments onto the differences among each other rather than describing all embodiments anew from the outset on, again and again.

The following description starts with embodiments for an apparatus for performing noise filling on a spectrum of an audio signal, first. Second, different embodiments are presented for various audio codecs, where such a noise filling may be built-in, along with specifics which could apply in connection with a respective audio codec presented. It is noted that the noise filling described next may, in any case, be performed at the decoding side. Depending on the encoder, however, the noise filling as described next may also be performed at the encoding side such as, for example, for analysis-by-synthesis reasons. An intermediate case according to which the modified way of noise filling in accordance with the embodiments outlined below merely partially changes the way the encoder works such as, for example, in order to determine a spectrally global noise filling level, is also described below.

Figure 1:
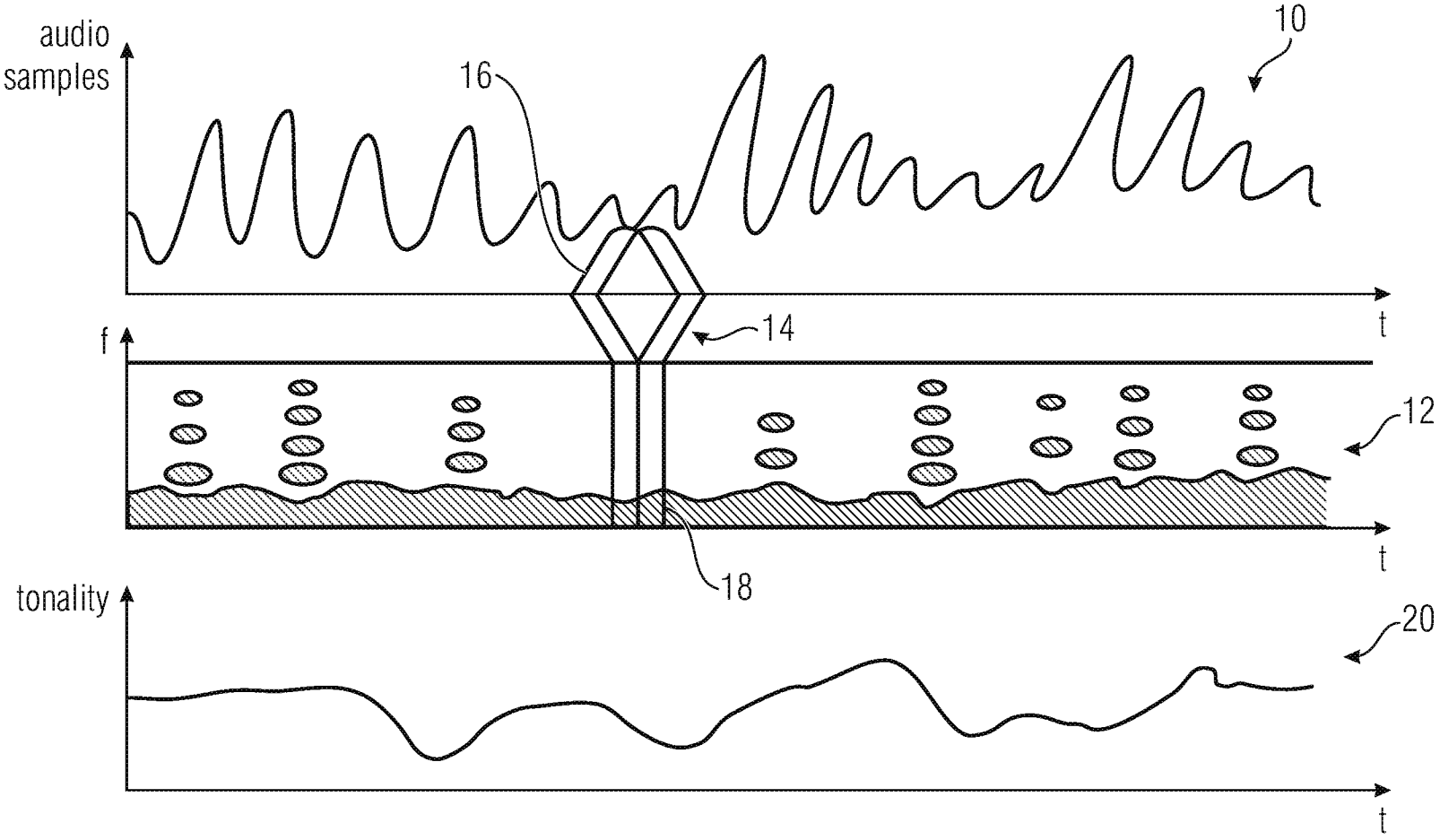
FIG. 1 shows, in a time-aligned manner, one above the other, from top to bottom, a time fragment out of an audio signal, its spectrogram using a schematically indicated "gray scale" spectrotemporal variation of the spectral energy, and the audio signal's tonality, for illustration purposes.

FIG. 1 shows, for illustration purposes, an audio signal 10, i.e. the temporal course of its audio samples, for example, the time-aligned spectrogram 12 of the audio signal having been derived from the audio signal 10, at least inter alias, via a suitable transformation such as a lapped transformation illustrated at 14 exemplary for two consecutive transform windows 16 and the associated spectrums 18 which, thus, represents a slice out of spectrogram 12 at a time instance corresponding to a mid of the associated transform window 16, for example. Examples for the spectrogram 12 and how same is derived are presented further below. In any case, the spectrogram 12 has been subject to some kind of quantization and thus has zero-portions where the spectral values at which the spectrogram 12 is spectrotemporally sampled are contiguously zero. The lapped transform 14 may, for example, be a critically sampled transform such as a MDCT. The transform windows 16 may have an overlap of 50% to each other but different embodiments are feasible as well. Further, the spectrotemporal resolution at which the spectrogram 12 is sampled into the spectral values may vary in time. In other words, the temporal distance between consecutive spectrums 18 of spectrogram 12 may vary in time, and the same applies to the spectral resolution of each spectrum 18. In particular, the variation in time as far the temporal distance between consecutive spectra 18 is concerned, may be inverse to the variation of the spectral resolution of the spectra. The quantization uses, for example, a spectrally varying, signal-adaptive quantization step size, varying, for example, in accordance with an LPC spectral envelope of the audio signal described by LP coefficients signaled in the data stream into which the quantized spectral values of the spectrogram 12 with the spectra 18 to be noise filled is coded, or in accordance with scale factors determined, in turn, in accordance with a psychoacoustic model, and signaled in the data stream.

Beyond that, in a time-aligned manner FIG. 1 shows a characteristic of the audio signal 10 and its temporal variation, namely the tonality of the audio signal. Generally speaking, the "tonality" indicates a measure describing how condensed the audio signal's energy is at a certain point of time in the respective spectrum 18 associated with that point in time. If the energy is spread much, such as in noisy temporal phases of the audio signal 10, then the tonality is low. But if the energy is substantially condensed to one or more spectral peaks, then the tonality is high.

Figure 2:
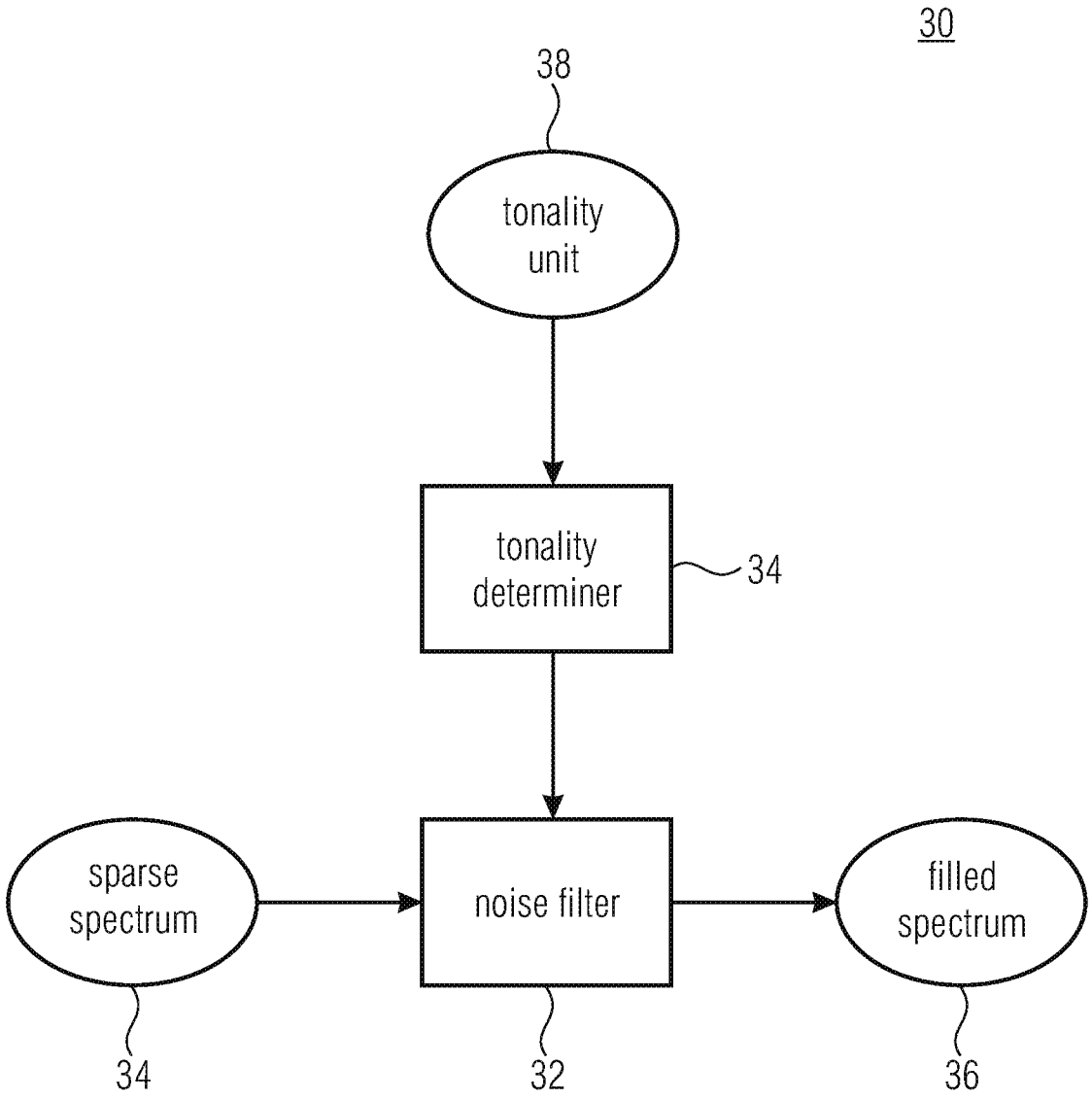
FIG. 2 shows a block diagram of a noise filling apparatus in accordance with an embodiment.

FIG. 2 shows an apparatus configured to perform noise filling on a spectrum of an audio signal in accordance with an embodiment of the present application. As will be described in more detail below, the apparatus is configured to perform the noise filling dependent on a tonality of the audio signal.

The apparatus of FIG. 2 is generally indicated using reference sign 30 and comprises a noise filler 32 and a tonality determiner 34, which is optional.

The actual noise filling is performed by noise filler 32. The noise filler 32 receives the spectrum to which the noise filling shall be applied. This spectrum is illustrated in FIG. 2 as sparse spectrum 34. The sparse spectrum 34 may be a spectrum 18 out of spectrogram 12. The spectra 18 enter noise filler 32 sequentially. The noise filler 32 subjects spectrum 34 to noise filling and outputs the "filled spectrum" 36. The noise filler 32 performs the noise filling dependent on a tonality of the audio signal, such as the tonality 20 in FIG. 1. Depending on the circumstance, the tonality may not be directly available. For example, existing audio codecs do not provide for an explicit signaling of the audio signal's tonality in the data stream, so that if apparatus 30 is installed at the decoding side, it would not be feasible to reconstruct the tonality without a high degree of false estimation. For example, the spectrum 34 may be, due to its sparseness and/or owing to its signal-adaptive varying quantization, no optimum basis for a tonality estimation.

Accordingly, it is the task of tonality determiner 34 to provide the noise filler 32 with an estimation of the tonality on the basis of another tonality hint 38 as will be described in more detail below. In accordance with the embodiments described later, the tonality hint 38 may be available at encoding and decoding sides anyway, by way of a respective coding parameter conveyed within the data stream of the audio codec within which apparatus 30 is, for example, used.

Figure 3:
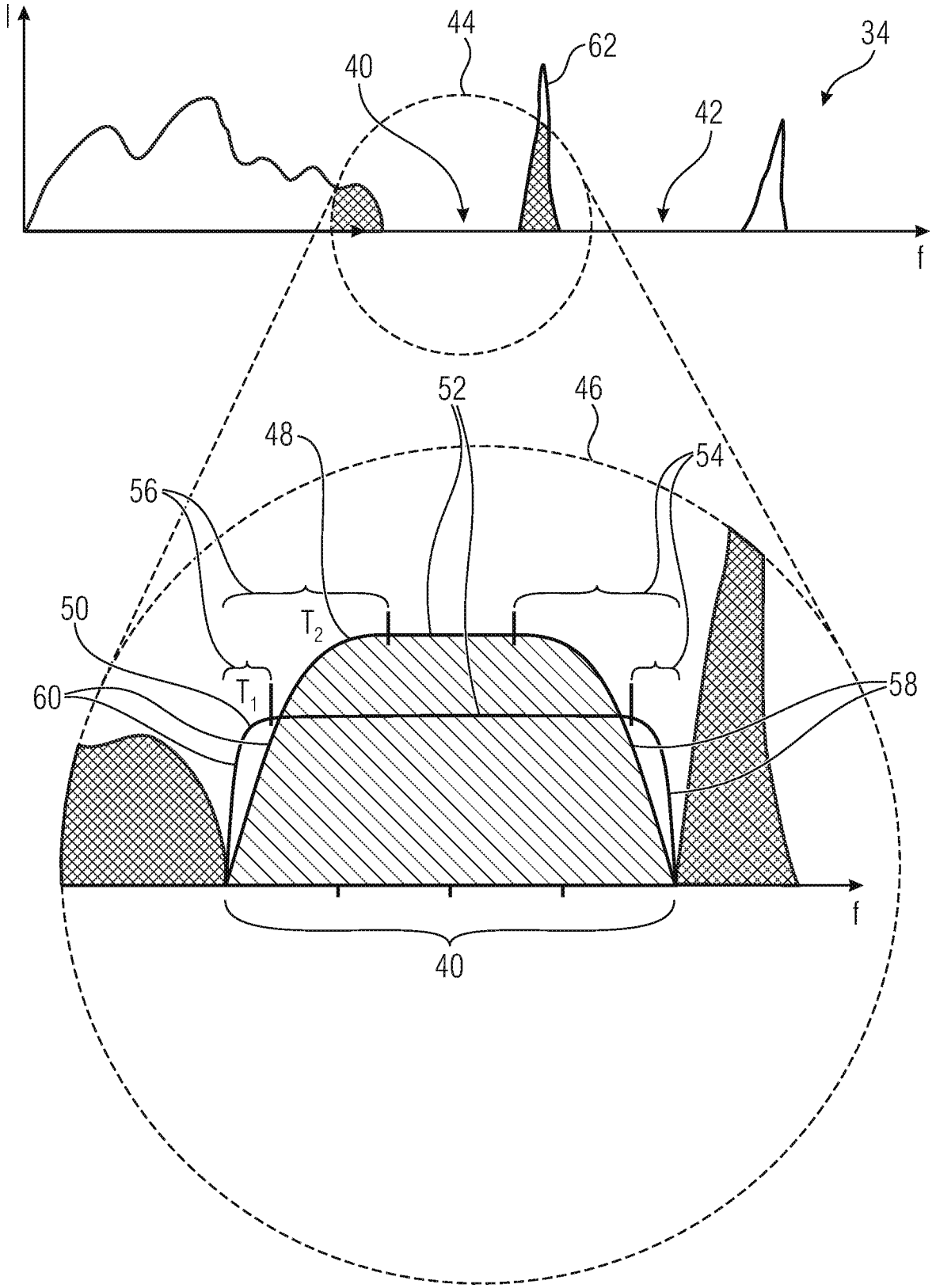
FIG. 3 shows a schematic of a spectrum to be subject to noise filling and a function used to spectrally shape noise used to fill a contiguous spectral zero-portion of this spectrum in accordance with an embodiment.

FIG. 3 shows an example for the sparse spectrum 34, i.e. a quantized spectrum having contiguous portions 40 and 42 consisting of runs of spectrally neighboring spectral values of spectrum 34, being quantized to zero. The contiguous portions 40 and 42 are, thus, spectrally disjoint or distanced from each other via at least one not quantized to zero spectral line in the spectrum 34.

The tonality dependency of the noise filling generally described above with respect to FIG. 2 may be implemented as follows. FIG. 3 shows a temporal portion 44 including a contiguous spectral zero-portion 40, exaggerated at 46. The noise filler 32 is configured to fill this contiguous spectral zero-portion 40 in a manner dependent on the tonality of the audio signal at the time to which the spectrum 34 belongs. In particular, the noise filler 32 fills the contiguous spectral zero-portion with noise spectrally shaped using a function assuming a maximum in an inner of the contiguous spectral zero-portion, and having outwardly falling edges, an absolute slope of which negatively depends on the tonality. FIG. 3 exemplarily shows two functions 48 and 50 for two different tonalities. Both functions are "unimodal", i.e. assume an absolute maximum in the inner of the contiguous spectral zero-portion 40 and have merely one local maximum which may be a plateau or a single spectral frequency. Here, the local maximum is assumed by functions 48 and 50 continuously over an extended interval 52, i.e. a plateau, arranged in the center of zero-portion 40. The functions' 48 and 50 domain is the zero-portion 40. The central interval 52 merely covers a center portion of zero-portion 40 and is flanked by an edge portion 54 at a higher-frequency side of interval 52, and a lower-frequency edge portion 56 at a lower-frequency side of interval 52. Within edge portion 54, functions 48 and 52 have a falling edge 58, and within edge portion 56, a rising edge 60. An absolute slope may be attributed to each edge 58 and 60, respectively, such as the mean slope within edge portion 54 and 56, respectively. That is, the slope attributed to falling edge 58 may be the mean slope of the respective function 48 and 52, respectively, within edge portion 54, and the slope attributed to rising edge 60 may be the mean slope of function 48 and 52, respectively, within edge portion 56.

As can be seen, the absolute value of the slope of edges 58 and 60 is higher for function 50 than for function 48. The noise filler 32 selects to fill the zero-portion 40 with function 50 for tonalities lower than tonalities for which noise filler 32 selects to use function 48 for filling zero-portion 40. By this measure, the noise filler 32 avoids clustering the immediate periphery of potentially tonal spectral peaks of spectrum 34, such as, for example, peak 62. The smaller the absolute slope of edges 58 and 60 is, the further away the noise filled into zero-portion 40 is from the non-zero portions of spectrum 34 surrounding zero-portion 40.

Noise filler 32 may, for example, choose to select function 48 in case of the audio signal's tonality being $\tau_2$, and function 50 in case of the audio signal's tonality being $\tau_1$, but the description brought forward further below will reveal that noise filler 32 may discriminate more than two different states of the audio signal's tonality, i.e. may support more than two different functions 48, 50 for filling a certain contiguous spectral zero-portion and choose between those depending on the tonality via a surjective mapping from tonalities to functions.

As a minor note, it is noted that the construction of functions 48 and 50 according to which same have a plateau in the inner interval 52, flanked by edges 58 and 60 so as to result in unimodal functions, is merely an example. Alternatively, bell-shaped functions may be used, for example, in accordance with an alternative. The interval 52 may alternatively be defined as the interval between which the function is higher than 95% of its maximum value.

Figure 4:
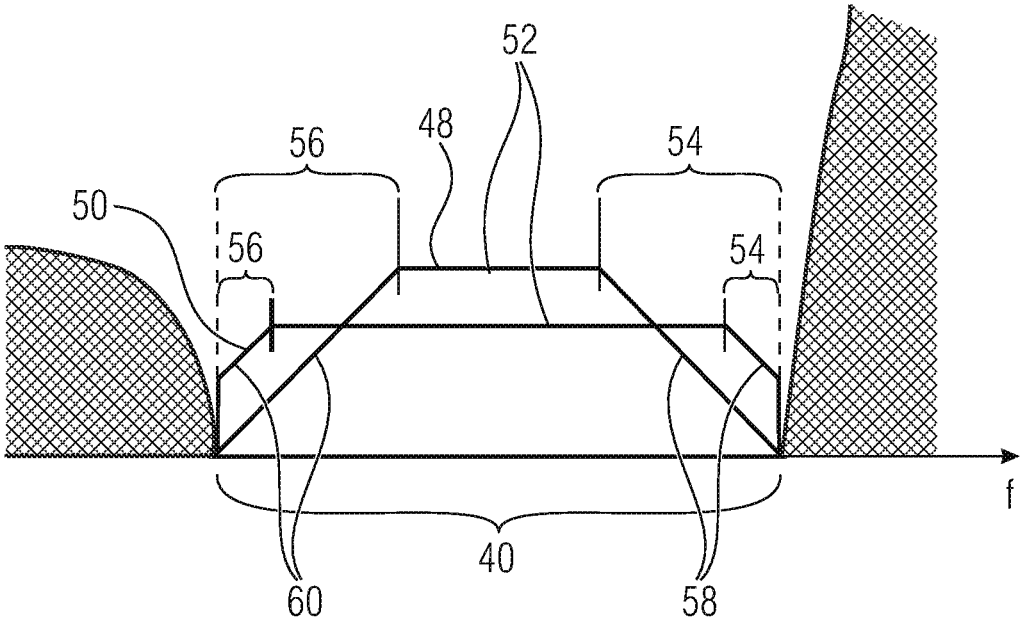
FIG. 4 shows a schematic of a spectrum to be subject to noise filling and a function used to spectrally shape noise used to fill a contiguous spectral zero-portion of this spectrum in accordance with a further embodiment.

FIG. 4 shows an alternative for the variation of the function used to spectrally shape the noise with which a certain contiguous spectral zero-portion 40 is filled by the noise filler 32, on the tonality. In accordance with FIG. 4, the variation pertains to the spectral width of edge portions 54 and 56 and the outwardly falling edges 58 and 60, respectively. As shown in FIG. 4, in accordance with example of FIG. 4, the edges' 58 and 60 slope may even be independent of, i.e. not changed in accordance with, the tonality. In particular, in accordance with the example of FIG. 4, noise filler 32 sets the function using which the noise for filling zero-portion 40 is spectrally shaped such that the spectral width of the outwardly falling edges 58 and 60 positively depends on the tonality, i.e. for higher tonalities, function 48 is used for which the spectral width of the outwardly falling edges 58 and 60 is greater, and for lower tonalities, function 50 is used for which the spectral width of the outwardly falling edges 58 and 60 is smaller.

FIG. 4 shows another example of a variation of a function used by noise filler 32 for spectrally shaping the noise with which the contiguous spectral zero-portion 40 is filled: here, the characteristic of the function which varies with the tonality is the integral over the outer quarters of zero-portion 40. The higher the tonality, the greater the interval. Prior to determining the interval, the function's overall interval over the complete zero-portion 40 is equalized/normalized such as to 1.

Figure 5:
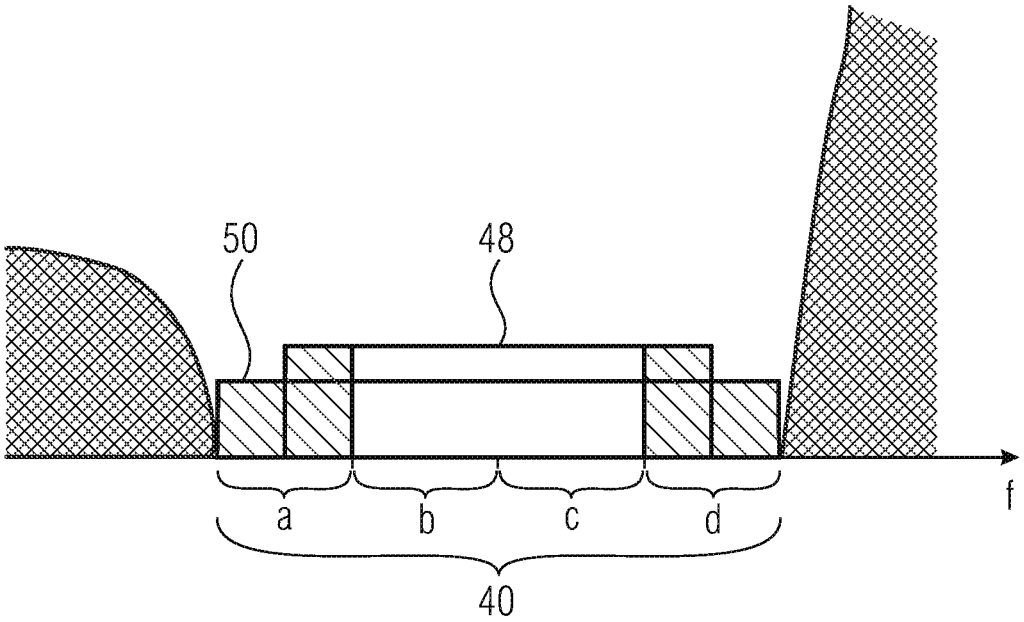
FIG. 5 shows a schematic of a spectrum to be subject to noise filling and a function used to spectrally shape noise used to fill a contiguous spectral zero-portion of this spectrum in accordance with an even further embodiment.

In order to explain this, see FIG. 5. The contiguous spectral zero-portion 40 is shown to be partitioned into four equal-sized quarters a, b, c, d, among which quarters a and d are outer quarters. As can be seen, both functions 50 and 48 have their center of mass in the inner, here exemplarily in the mid of the zero-portion 40, but both of them extend from the inner quarters b, c into the outer quarters a and d.

The overlapping portion of functions 48 and 50, overlapping the outer quarters a and d, respectively, is shown simply shaded.

In FIG. 5, both functions have the same integral over the whole zero-portion 40, i.e. over all four quarters a, b, c, d. The integral is, for example, normalized to 1.

In this situation, the integral of function 50 over quarters a, d is greater than the integral of function 48 over quarters a, d and accordingly, noise filler 32 uses function 50 for higher tonalities and function 48 for lower tonalities, i.e. the integral over the outer quarters of the normalized functions 50 and 48 negatively depends on the tonality.

For illustration purposes, in case of FIG. 5 both functions 48 and 50 have been exemplarily shown to be constant or binary functions. Function 50, for example, is a function assuming a constant value over the whole domain, i.e. the whole zero-portion 40, and function 48 is a binary function being zero at the outer edges of zero-portion 40, and assuming a non-zero constant value therein between. It should be clear that, generally speaking, functions 50 and 48 in accordance with the example of FIG. 5 may be any constant or unimodal function such as ones corresponding to those shown in FIGS. 3 and 4. To be even more precise, at least one may be unimodal and at least one (piecewise-) constant and potential further ones either one of unimodal or constant.

Although the type of variation of functions 48 and 50 depending on the tonality varies, all examples of FIGS. 3 to 5 have in common that, for increasing tonality, the degree of smearing-up immediate surroundings of tonal peaks in the spectrum 34 is reduced or avoided so that the quality of noise filling is increased since the noise filling does not negatively affect tonal phases of the audio signal and nevertheless results in a pleasant approximation of non-tonal phases of the audio signal.

Figure 6:
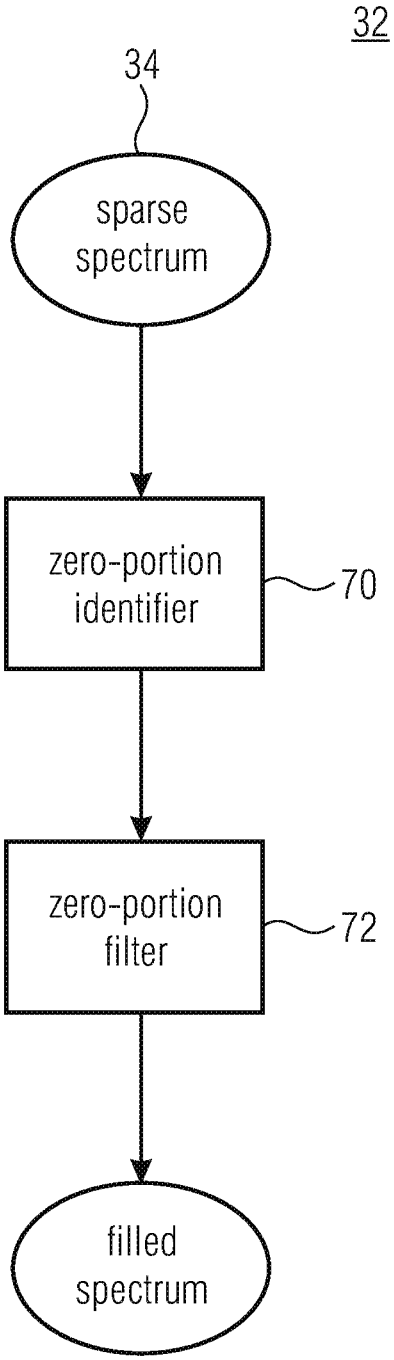
FIG. 6 shows a block diagram of the noise filler of FIG. 2 in accordance with an embodiment.

Until now, the description of FIGS. 3 to 5 focused on the filling of one contiguous spectral zero-portion. In accordance with the embodiment of FIG. 6, the apparatus of FIG. 2 is configured to identify contiguous spectral zero-portions of the audio signal's spectrum and to apply the noise filling onto the contiguous spectral zero-portions thus identified. In particular, FIG. 6 shows the noise filler 32 of FIG. 2 in more detail as comprising a zero-portion identifier 70 and a zero-portion filler 72. The zero-portion identifier searches in spectrum 34 for contiguous spectral zero-portions such as 40 and 42 in FIG. 3. As already described above, contiguous spectral zero-portions may be defined as runs of spectral values having been quantized to zero. The zero-portion identifier 70 may be configured to confine the identification onto a high-frequency spectral portion of the audio signal spectrum starting, i.e. lying above, some starting frequency. Accordingly, the apparatus may be configured to confine the performance of the noise filling onto such a high-frequency spectral portion. The starting frequency above which the zero-portion identifier 70 performs the identification of contiguous spectral zero-portions, and above which the apparatus is configured to confine the performance of the noise filling, may be fixed or may vary. For example, explicit signaling in an audio signal's data stream into which the audio signal is coded via its spectrum may be used to signal the starting frequency to be used.

The zero-portion filler 72 is configured to fill the identified contiguous spectral zero-portions identified by identifier 70 with noise spectrally shaped in accordance with a function as described above with respect to FIG. 3, 4 or 5. Accordingly, the zero-portion filler 72 fills the contiguous spectral zero-portions identified by identifier 70 with functions set dependent on a respective contiguous spectral zero-portion's width, such as the number of spectral values having been quantized to zero of the run of zero-quantized spectral values of the respective contiguous spectral zero-portion, and the tonality of the audio signal.

In particular, the individual filling of each contiguous spectral zero-portion identified by identifier 70 may be performed by filler 72 as follows: the function is set dependent on the contiguous spectral zero-portion's width so that the function is confined to the respective contiguous spectral zero-portion, i.e. the domain of the function coincides with the contiguous spectral zero-portion's width. The setting of the function is further dependent on the tonality of the audio signal, namely in the manner outlined above with respect to FIGS. 3 to 5, so that if the tonality of the audio signal increases, the function's mass becomes more compact in the inner of the respective contiguous zero-portion and distanced from the respective contiguous spectral zero-portion's edges. Using this function, a preliminarily filled state of the contiguous spectral zero-portion according to which each spectral values is set to a random, pseudo-random or patched/copied value, is spectrally shaped, namely by multiplication of the function with the preliminary spectral values.

Figure 7:
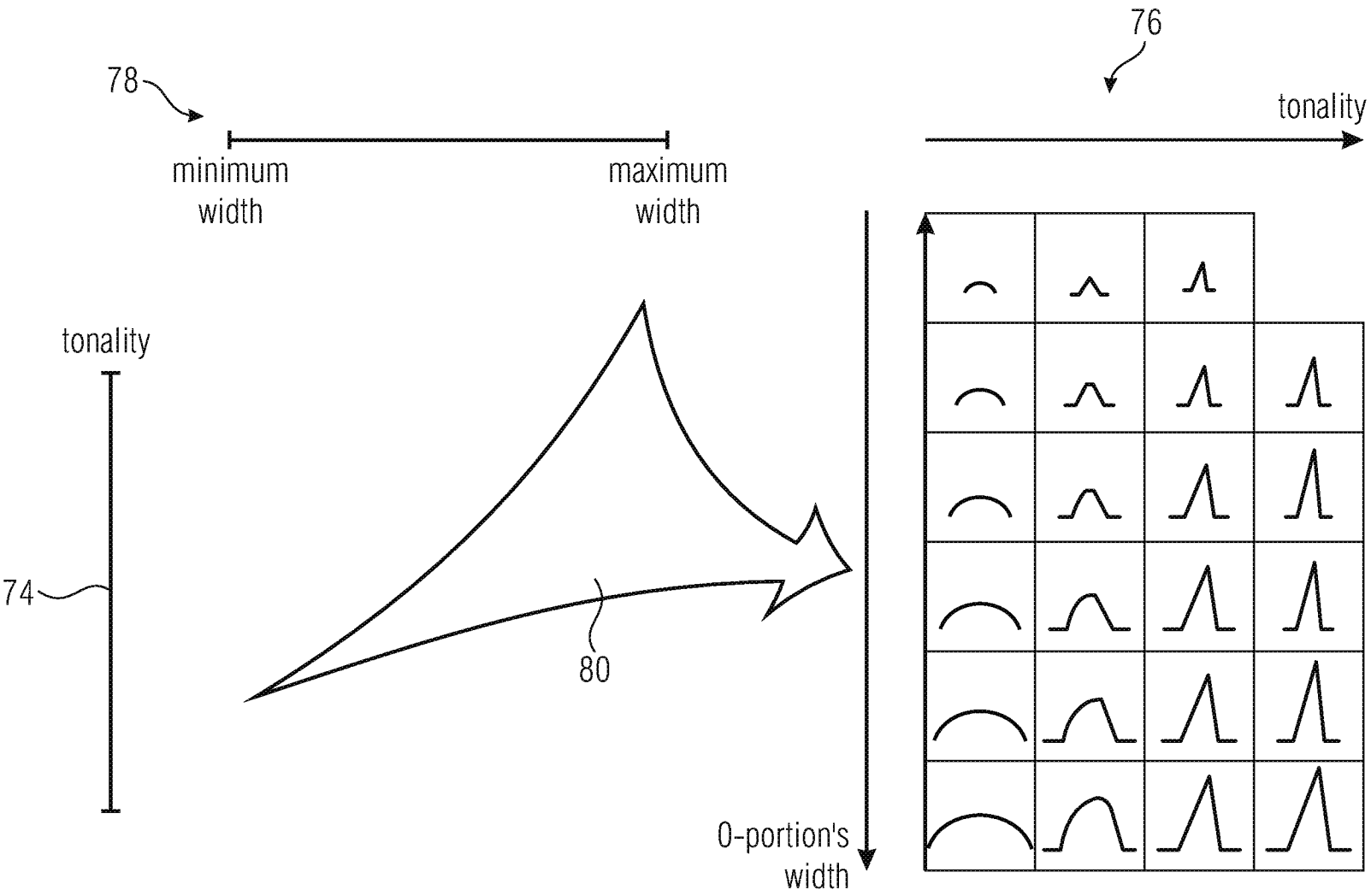
FIG. 7 schematically shows a possible relationship between the audio signal's tonality determined on the one hand and the possible functions available for spectrally shaping a contiguous spectral zero-portion on the other hand in accordance with an embodiment.

It has already been outlined above that the noise filling's dependency on the tonality may discriminate between more than only two different tonalities such as 3, 4 or even more then 4. FIG. 7, for example, shows the domain of possible tonalities, i.e. the interval of possible inter tonality values, as determined by determiner 34 at reference sign 74. At 76, FIG. 7 exemplarily shows the set of possible functions used for spectrally shaping the noise with which the contiguous spectral zero-portions may be filled. The set 76 as illustrated in FIG. 7 is a set of discrete function instantiations mutually distinguishing from each other by spectral width or domain length and/or shape, i.e. compactness and distance from the outer edges. At 78, FIG. 7 further shows the domain of possible zero-portion widths. While the interval 78 is an interval of discrete values ranging from some minimum width to some maximum width, the tonality values output by determiner 34 to measure the audio signal's tonality may either be integer valued or of some other type, such as floating point values. The mapping from the pair of intervals 74 and 78 to the set of possible functions 76 may be realized by table look-up or using a mathematical function. For example, for a certain contiguous spectral zero-portion identified by identifier 70, zero-portion filler 72 may use the width of the respective contiguous spectral zero-portion and the current tonality as determined by determiner 34 so as to look-up in a table a function of set 76 defined, for example, as a sequence of function values, the length of the sequence coinciding with the contiguous spectral zero-portion's width. Alternatively, zero-portion filler 72 looks-up function parameters and fills-in these function's parameters into a predetermined function so as to derive the function to be used for spectrally shaping the noise to be filled into the respective contiguous spectral zero-portion. In another alternative, zero-portion filler 72 may directly insert the respective contiguous spectral zero-portion's width and the current tonality into a mathematic formula in order to arrive at function parameters in order to build-up the respective function in accordance with the function parameter's mathematically computed.

Until now, the description of certain embodiments of the present application focused on the function's shape used to spectrally shape the noise with which certain contiguous spectral zero-portions are filled. It is advantageous, however, to control the overall level of noise added to a certain spectrum to be noise filled so as to result in a pleasant reconstruction, or to even control the level of noise introduction spectrally.

Figure 8:
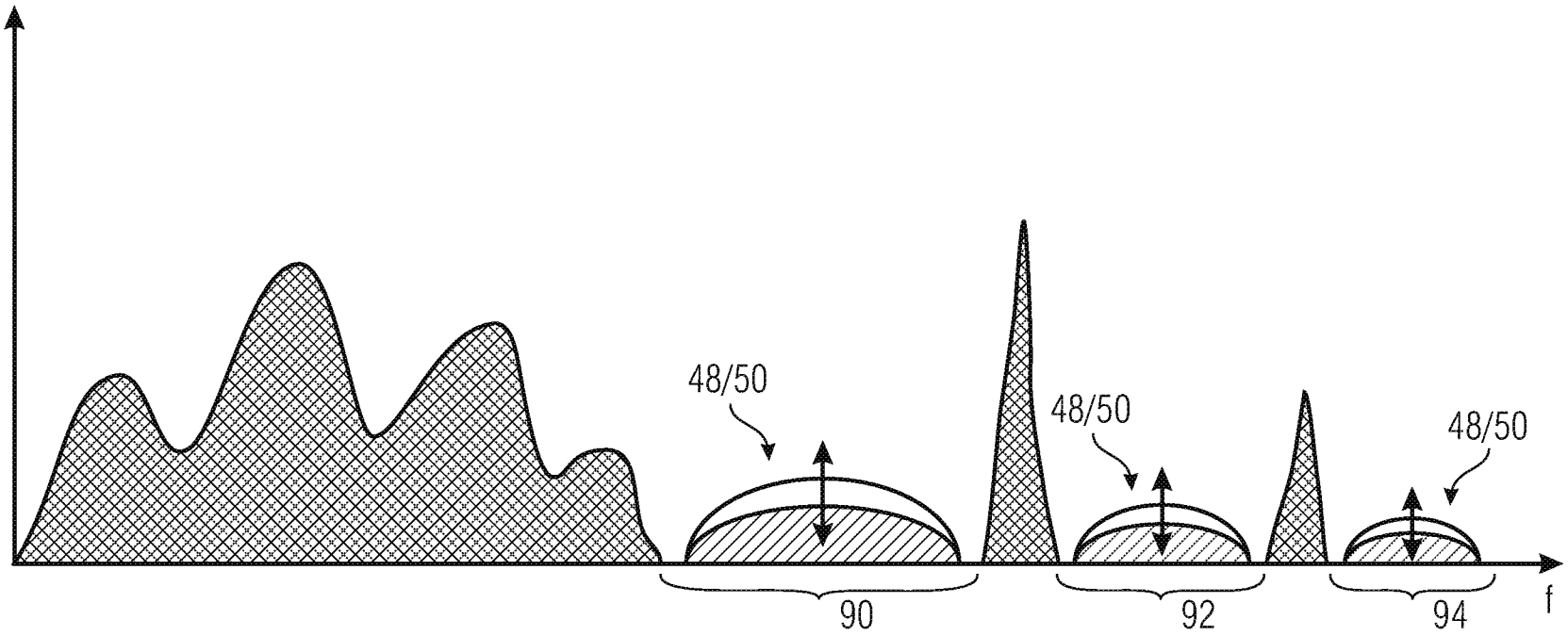
FIG. 8 schematically shows a spectrum to be noise filled with additionally showing the functions used to spectrally shape the noise for filling contiguous spectral zero-portions of the spectrum in order to illustrate how to scale the noise's level in accordance with an embodiment.

FIG. 8 shows a spectrum to be noise filled, where the portions not quantized to zero and accordingly, not subject to noise filling, are indicated cross-hatched, wherein three contiguous spectral zero-portions 90, 92 and 94 are shown in a pre-filled state being illustrated by the zero-portions having inscribed thereinto the selected function for spectral shaping the noise filled into these portions 90-94, using a don't-care scale.

In accordance with one embodiment, the available set of functions 48, 50 for spectrally shaping the noise to be filled into the portions 90-94, all have a predefined scale which is known to encoder and decoder. A spectrally global scaling factor is signaled explicitly within the data stream into which the audio signal, i.e. the non-quantized part of the spectrum, is coded. This factor indicates, for example, the RMS or another measure for a level of noise, i.e. random or pseudorandom spectral line values, with which portions 90-94 are pre-set at the decoding side with then being spectrally shaped using the tonality dependently selected functions 48, 50 as they are. As to how the global noise scaling factor could be determined at the encoder side is described further below. Let, for example, A be the set of indices i of spectral lines where the spectrum is quantized to zero and which belong to any of the portions 90-94, and let N denote the global noise scaling factor. The values of the spectrum shall be denoted $x_i$. Further, "random(N)" shall denote a function giving a random value of a level corresponding to level "N" and left(i) shall be a function indicating for any zero-quantized spectral value at index i the index of the zero-quantized value at the low-frequency end of the zero-portion to which i belongs, and $F_i(j)$ with j=0 to $J_i-1$ shall denote the function 48 or 50 assigned to, depending on the tonality, the zero-portion 90-94 starting at index i, with $J_i$ indicating the width of that zero-portion. Then, portions 90-94 are filled according to $x_i=F_{left(i)}(i-\text{left}(i))\cdot\text{random}(N)$.

Additionally, the filling of noise into portions 90-94, may be controlled such that the noise level decreases from low to high frequencies. This may be done by spectrally shaping the noise with which portions are pre-set, or spectrally shaping the arrangement of functions 48,50 in accordance with a low-pass filter's transfer function. This may compensate for a spectral tilt caused when re-scaling/dequantizing the filled spectrum due to, for example, a pre-emphasis used in determining the spectral course of the quantization step size. Accordingly, the steepness of the decrease or the low-pass filter's transfer function may be controlled according to a degree of pre-emphasis applied. Applying the nomenclature used above, portions 90-94 may be filled according to $x_i=F_{left(i)}(i-\text{left}(i))\cdot\text{random}(N)\cdot\text{LPF}(i)$ with LPF (i) denoting the low-frequency filter's transfer function which may be linear. Depending on the circumstances, the function LPF which corresponds to function 15 may have a positive slope and LPF changed to read HPF accordingly.

Instead of using a fixed scaling of the functions selected depending on tonality and zero-portion's width, the just outlined spectral tilt correction may directly be accounted for by using the spectral position of the respective contiguous zero-portion also as an index in looking-up or otherwise determining 80 the function to be used for spectrally shaping the noise with which the respective contiguous spectral zero-portion has to be filled. For example, a mean value of the function or its pre-scaling used for spectrally shaping the noise to be filled into a certain zero-portion 90-94 may depend on the zero-portion's 90-94 spectral position so that, over the whole bandwidth of the spectrum, the functions used for the contiguous spectral zero-portions 90-94 are pre-scaled so as to emulate a low-pass filter transfer function so as to compensate for any high pass pre-emphasis transfer function used to derive the non-zero quantized portions of the spectrum.

Figure 9:
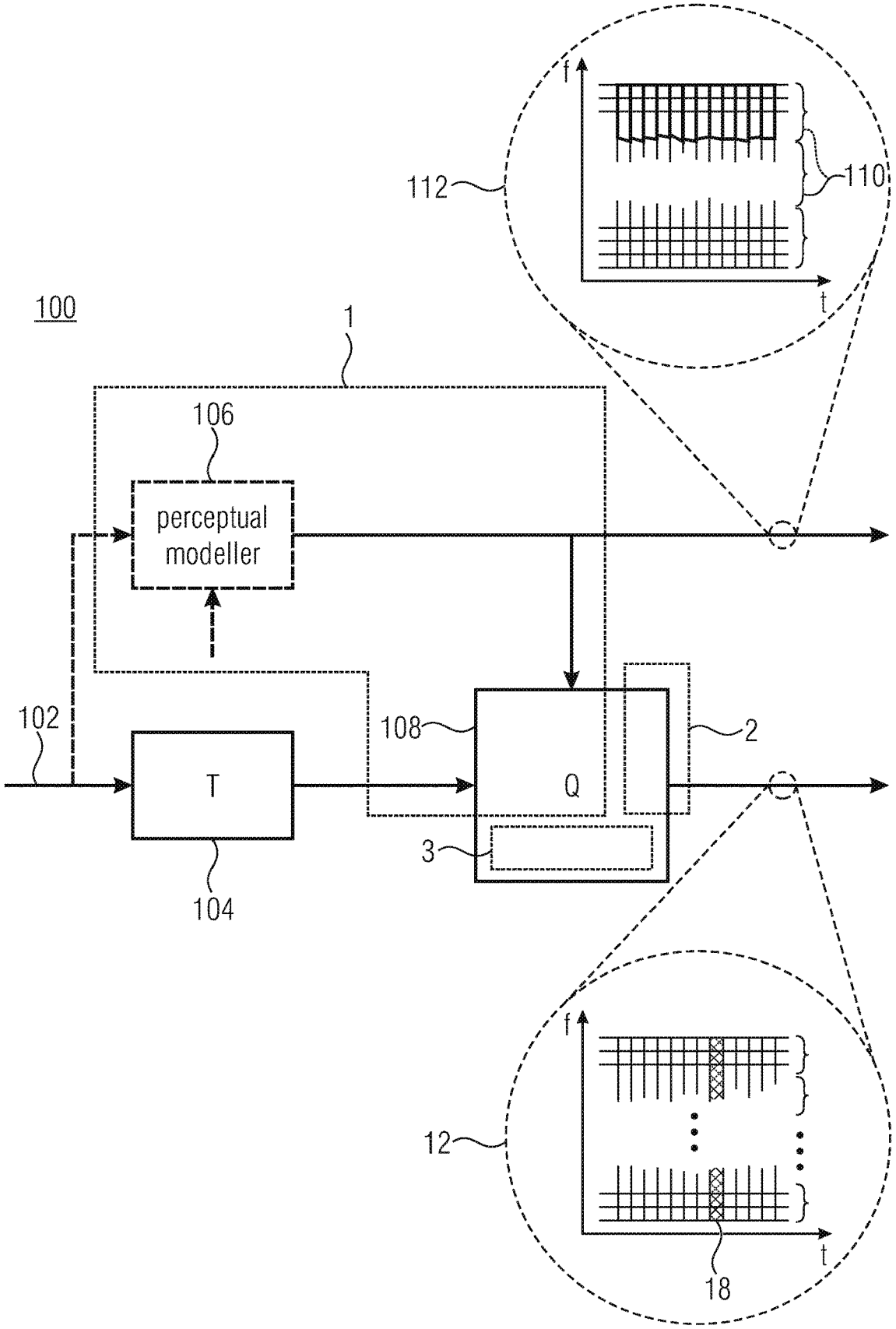
FIG. 9 shows a block diagram of an encoder which may be used within an audio codec adopting the noise filling concept described with respect to FIGS. 1 to 8.
Figure 10:
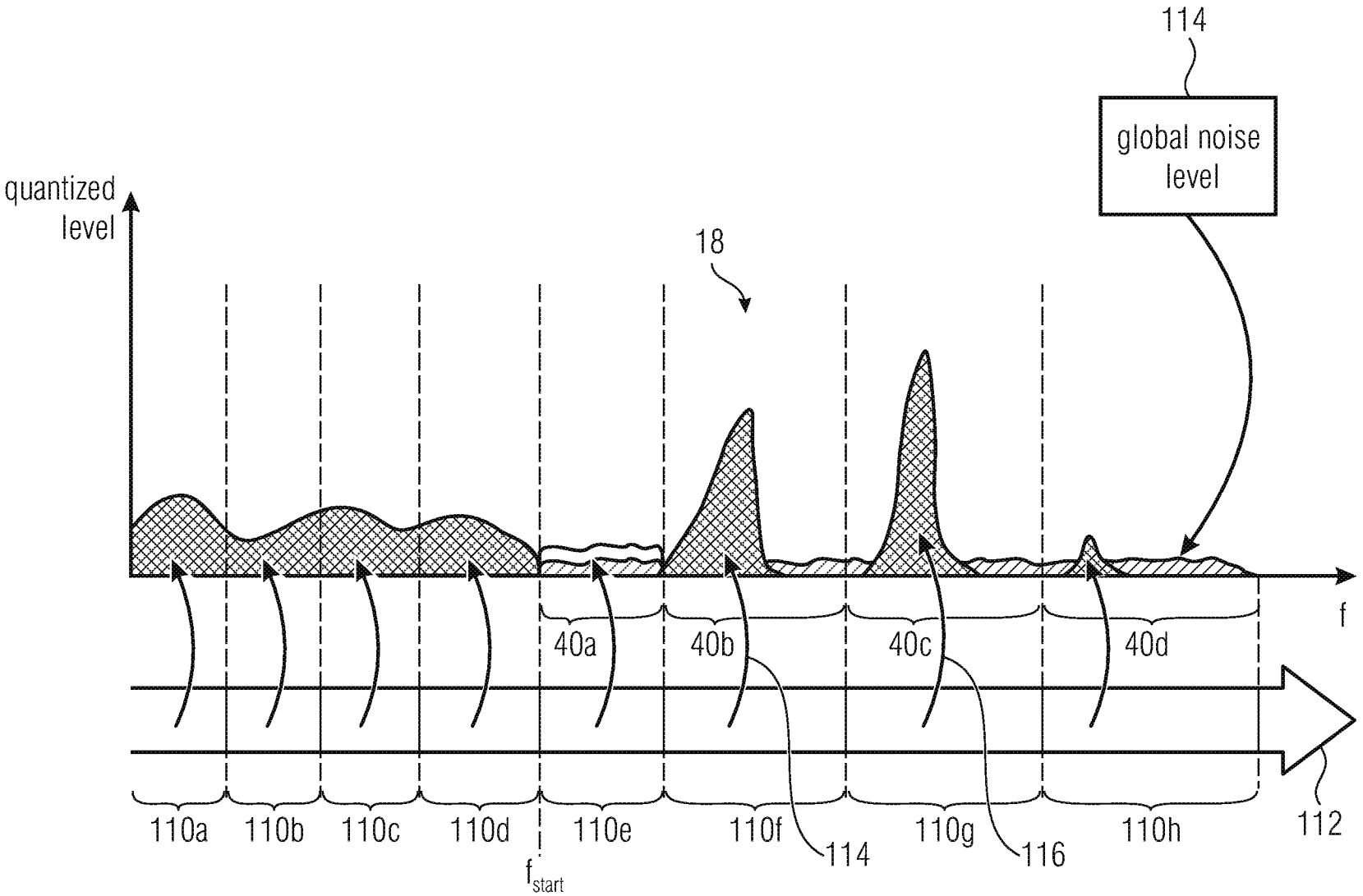
FIG. 10 shows schematically a quantized spectrum to be noise filled as coded by the encoder of FIG. 9 along with transmitted side information, namely scale factors and global noise level, in accordance with an embodiment.

Having described embodiments for performing the noise filling, in the following embodiments for audio codecs are presented where the noise filling outlined above may be advantageously built into. FIGS. 9 and 10 for example show a pair of an encoder and a decoder, respectively, together implementing a transform-based perceptual audio codec of the type forming the basis of, for example, AAC (Advanced Audio Coding). The encoder 100 shown in FIG. 9 subjects the original audio signal 102 to a transform in a transformer 104. The transformation performed by transformer 104 is, for example, a lapped transform which corresponds to a transformation 14 of FIG. 1: it spectrally decomposes the inbound original audio signal 102 by subjecting consecutive, mutually overlapping transform windows of the original audio signal into a sequence of spectrums 18 together composing spectrogram 12. As denoted above, the inter-transform-window patch which defines the temporal resolution of spectrogram 12 may vary in time, just as the temporal length of the transform windows may do which defines the spectral resolution of each spectrum 18. The encoder 100 further comprises a perceptual modeller 106 which derives from the original audio signal, on the basis of the time-domain version entering transformer 104 or the spectrally-decomposed version output by transformer 104, a perceptual masking threshold defining a spectral curve below which quantization noise may be hidden so that same is not perceivable.

The spectral line-wise representation of the audio signal, i.e. the spectrogram 12, and the masking threshold enter quantizer 108 which is responsible for quantizing the spectral samples of the spectrogram 12 using a spectrally varying quantization step size which depends on the masking threshold: the larger the masking threshold, the smaller the quantization step size is. In particular, the quantizer 108 informs the decoding side of the variation of the quantization step size in the form of so-called scale factors which, by way of the just-described relationship between quantization step size on the one hand and perceptual masking threshold on the other hand, represent a kind of representation of the perceptual masking threshold itself. In order to find a good compromise between the amount of side information to be spent for transmitting the scale factors to the decoding side, and the granularity of adapting the quantization noise to the perceptual masking threshold, quantizer 108 sets/varies the scale factors in a spectrotemporal resolution which is lower than, or coarser than, the spectrotemporal resolution at which the quantized spectral levels describe the spectral line-wise representation of the audio signal's spectrogram 12. For example, the quantizer 108 subdivides each spectrum into scale factor bands 110 such as bark bands, and transmits one scale factor per scale factor band 110. As far as the temporal resolution is concerned, same may also be lower as far as the transmission of the scale factors is concerned, compared to the spectral levels of the spectral values of spectrogram 12.

Both the spectral levels of the spectral values of the spectrogram 12, as well as the scale factors 112 are transmitted to the decoding side. However, in order to improve the audio quality, the encoder 100 transmits within the data stream also a global noise level which signals to the decoding side the noise level up to which zero-quantized portions of representation 12 have to be filled with noise before rescaling, or dequantizing, the spectrum by applying the scale factors 112. This is shown in FIG. 10. FIG. 10 shows, using cross-hatching, the not yet rescaled audio signal's spectrum such as 18 in FIG. 9. It has contiguous spectral zero-portions 40*a*, 40*b*, 40*c* and 40*d*. The global noise level 114 which may also be transmitted in the data stream for each spectrum 18, indicates to the decoder the level up to which these zero-portions 40*a* to 40*d* shall be filled with noise before subjecting this filled spectrum to the rescaling or requantization using the scale factors 112.

As already denoted above, the noise filling to which the global noise level 114 refers, may be subject to a restriction in that this kind of noise filling merely refers to frequencies above some starting frequency which is indicated in FIG. 10 merely for illustration purposes as $f_{start}$.

FIG. 10 also illustrates another specific feature, which may be implemented in the encoder 100: as there may be spectrums 18 comprising scale factor bands 110 where all spectral values within the respective scale factor bands have been quantized to zero, the scale factor 112 associated with such a scale factor band is actually superfluous. Accordingly, the quantizer 100 uses this very scale factor for individually filling-up the scale factor band with noise in addition to the noise filled into the scale factor band using the global noise level 114, or in other terms, in order to scale the noise attributed to the respective scale factor band responsive to the global noise level 114. See, for example, FIG. 10. FIG. 10 shows an exemplary subdivision of spectrum 18 into scale factor bands 110*a* to 110*h*. Scale factor band 110*e* is a scale factor band, the spectral values of which have all been quantized to zero. Accordingly, the associated scale factor 112 is "free" and is used to determine 114 the level of the noise up to which this scale factor band is filled completely. The other scale factor bands which comprise spectral values quantized to non-zero levels, have scale factors associated therewith which are used to rescale the spectral values of spectrum 18 not having been quantized to zero, including the noise using which the zero-portions 40*a* to 40*d* have been filled, which scaling is indicated using arrow 116, representatively.

The encoder 100 of FIG. 9 may already take into account that within the decoding side the noise filling using global noise level 114 will be performed using the noise filling embodiments described above, e.g. using a dependency on the tonality and/or imposing a spectrally global tilt on the noise and/or varying the noise filling starting frequency and so forth.

As far as the dependency on the tonality is concerned, the encoder 100 may determine the global noise level 114, and insert same into the data stream, by associating to the zero-portions 40*a* to 40*d* the function for spectrally shaping the noise for filling the respective zero-portion. In particular, the encoder may use these functions in order to weight the original, i.e. weighted but not yet quantized, audio signal's spectral values in these portions 40*a* to 40*d* in order to determine the global noise level 114. Thereby, the global noise level 114 determined and transmitted within the data stream, leads to a noise filling at the decoding side which more closely recovers the original audio signal's spectrum.

The encoder 100 may, depending on the audio signal's content, decide on using some coding options which, in turn, may be used as tonality hints such as the tonality hint 38 shown in FIG. 2 so as to allow the decoding side to correctly set the function for spectrally shaping the noise used to fill portions 40*a* to 40*d*. For example, encoder 100 may use temporal prediction in order to predict one spectrum 18 from a previous spectrum using a so-called long-term prediction gain parameter. In other words, the long-term prediction gain may set the degree up to which such temporal prediction is used or not. Accordingly, the long term prediction gain, or LTP gain, is a parameter which may be used as a tonality hint as the higher the LTP gain, the higher the tonality of the audio signal will most likely be. Thus, the tonality determiner 34 of FIG. 2, for example, may set the tonality according to a monotonous positive dependency on the LTP gain. Instead of, or in addition to, an LTP gain, the data stream may comprise an LTP enablement flag signaling switching on/off the LTP, thereby also revealing a binary-valued hint concerning the tonality, for example.

Additionally or alternatively, encoder 100 may support temporal noise shaping. That is, on a per spectrum 18 basis, for example, encoder 100 may choose to subject spectrum 18 to temporal noise shaping with indicating this decision by way of a temporal noise shaping enablement flag to the decoder. The TNS enablement flag indicates whether the spectral levels of spectrum 18 form the prediction residual of a spectral, i.e. along frequency direction determined, linear prediction of the spectrum or whether the spectrum is not LP predicted. If TNS is signaled to be enabled, the data stream additionally comprises the linear prediction coefficients for spectrally linear predicting the spectrum so that the decoder may recover the spectrum using these linear prediction coefficients by applying same onto the spectrum before or after the rescaling or dequantizing. The TNS enablement flag is also a tonality hint: if the TNS enablement flag signals TNS to be switched on, e.g. on a transient, then the audio signal is very unlikely to be tonal, as the spectrum seems to be well predictable by linear prediction along frequency axis and, hence, non-stationary. Accordingly, the tonality may be determined on the basis of the TNS enablement flag such that the tonality is higher if the TNS enablement flag disables TNS, and is lower if the TNS enablement flag signals the enablement of TNS. Instead of, or in addition to, a TNS enablement flag, it may be possible to derive from the TNS filter coefficients a TNS gain indicating a degree up to which TNS is usable for predicting the spectrum, thereby also revealing a more-than-two-valued hint concerning the tonality.

Other coding parameters may also be coded within the data stream by encoder 100. For example, a spectral rearrangement enablement flag may signal one coding option according to which the spectrum 18 is coded by rearranging the spectral levels, i.e. the quantized spectral values, spectrally with additionally transmitting within the data stream the rearrangement prescription so that the decoder may rearrange, or rescramble, the spectral levels so as to recover spectrum 18. If the spectrum rearrangement enablement flag is enabled, i.e. spectrum rearrangement is applied, this indicates that the audio signal is likely to be tonal as rearrangement tends to be more rate/distortion effective in compressing the data stream if there are many tonal peaks within the spectrum. Accordingly, additionally or alternatively, the spectrum rearrangement enablement flag may be used as a tonal hint and the tonality used for noise filling may be set to be larger in case of the spectrum rearrangement enablement flag being enabled, and lower if the spectrum arrangement enablement flag is disabled.

For the sake of completeness, and also with reference to FIG. 5, it is noted that the number of different functions for spectrally shaping a zero-portion 40*a* to 40*d*, i.e. the number of different tonalities discriminated for setting the function for spectrally shaping, may for example be larger than four, or even larger than eight at least for contiguous spectral zero-portions' widths above a predetermined minimum width.

As far as the concept of imposing a spectrally global tilt on the noise and taking the same into account when computing the noise level parameter at encoding side is concerned, the encoder 100 may determine the global noise level 114, and insert same into the data stream, by weighting portions of the not-yet quantized, but with the inverse of the perceptual weighting function weighted audio signal's spectral values, spectrally co-located to zero-portions 40*a* to 40*d*, with a function spectrally extending at least over the whole noise filling portion of the spectrum bandwidth and having a slope of opposite sign relative to the function 15 used at the decoding side for noise filling, for example and measuring the level based on the thus weighted non-quantized values.

Figure 11:
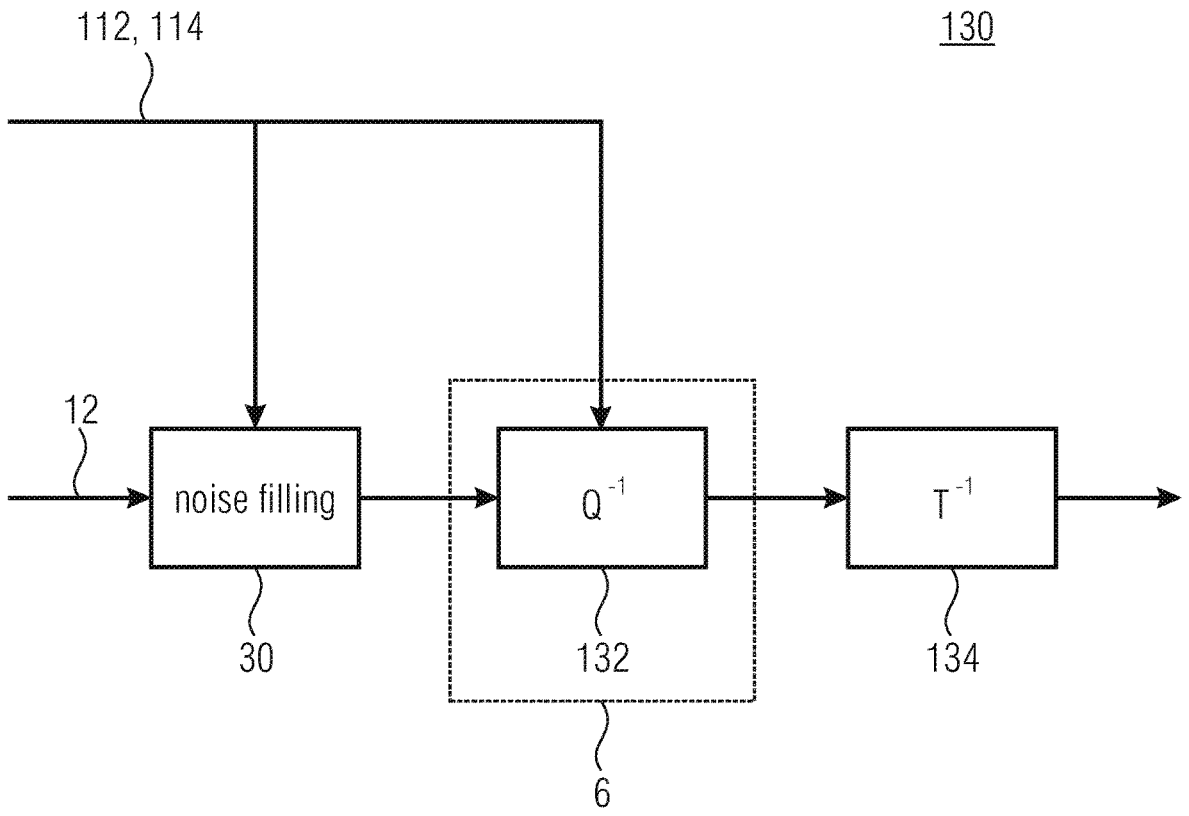
FIG. 11 shows a block diagram of a decoder fitting to the encoder of FIG. 9 and including a noise filling apparatus in accordance with FIG. 2.

FIG. 11 shows a decoder fitting to the encoder of FIG. 9. The decoder of FIG. 11 is generally indicated using reference sign 130 and comprises a noise filler 30 corresponding to the above described embodiments, a dequantizer 132 and an inverse transformer 134. The noise filler 30 receives the sequence of spectrums 18 within spectrogram 12, i.e. the spectral line-wise representation including the quantized spectral values, and, optionally, tonality hints from the data stream such as one or several of the coding parameters discussed above. The noise filler 30 then fills-up the contiguous spectral zero-portions 40*a* to 40*d* with noise as described above such as using the tonality dependency described above and/or by imposing a spectrally global tilt on the noise, and using the global noise level 114 for scaling the noise level as described above. Thus filled, these spectrums reach dequantizer 132, which in turn dequantizes or rescales the noise filled spectrum using the scale factors 112. The inverse transformer 134, in turn, subjects the dequantized spectrum to an inverse transformation so as to recover the audio signal. As described above, the inverse transformation 134 may also comprise an overlap-add-process in order to achieve the time-domain aliasing cancellation caused in case of the transformation used by transformer 104 being a critically sampled lapped transform such as an MDCT, in which case the inverse transformation applied by inverse transformer 134 would be an IMDCT (inverse MDCT).

As already described with respect to FIGS. 9 and 10, the dequantizer 132 applies the scale factors to the pre-filled spectrum. That is, spectral values within scale factor bands not completely quantized to zero are scaled using the scale factor irrespective of the spectral value representing a non-zero spectral value or a noise having been spectrally shaped by noise filler 30 as described above. Completely zero-quantized spectral bands have scale factors associated therewith, which are completely free to control the noise filling and noise filler 30 may either use this scale factor to individually scale the noise with which the scale factor band has been filled by way of the noise filler's 30 noise filling of contiguous spectral zero-portions, or noise filler 30 may use the scale factor to additionally fill-up, i.e. add, additional noise as far as these zero-quantized spectral bands are concerned.

It is noted that the noise which noise filler 30 spectrally shapes in the tonality dependent manner described above and/or subjects to a spectrally global tilt in a manner described above, may stem from a pseudorandom noise source, or may be derived from noise filler 30 on the basis of spectral copying or patching from other areas of the same spectrum or related spectrums, such as a time-aligned spectrum of another channel, or a temporally preceding spectrum. Even patching from the same spectrum may be feasible, such as copying from lower frequency areas of spectrum 18 (spectral copy-up). Irrespective of the way the noise filler 30 derives the noise, filler 30 spectrally shapes the noise for filling into contiguous spectral zero-portions 40*a* to 40*d* in the tonality dependent manner described above and/or subjects same to a spectrally global tilt in a manner described above.

Figure 12:
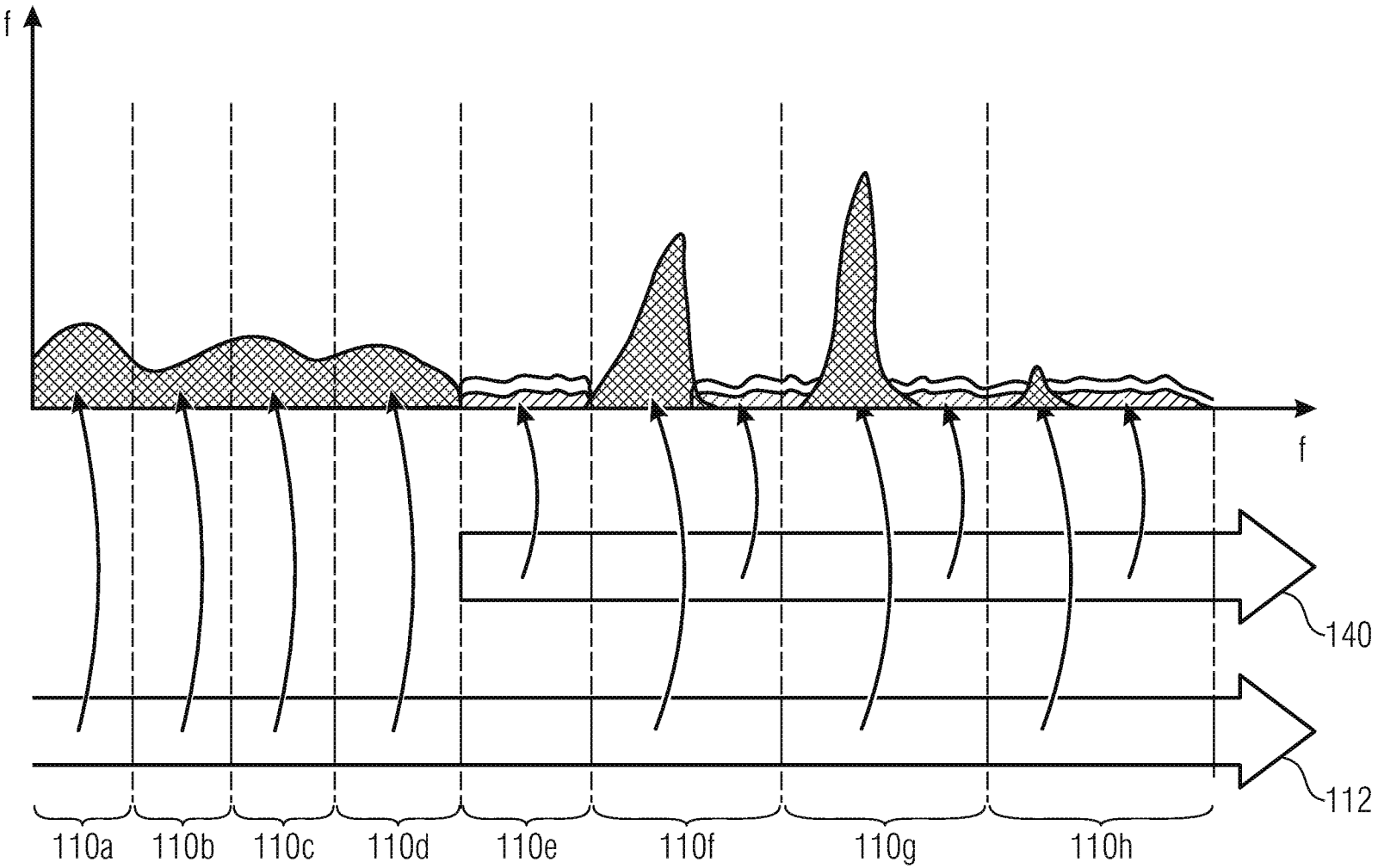
FIG. 12 shows a schematic of a spectrogram with associated side information data in accordance with a variant of an implementation of the encoder and decoder of FIGS. 9 and 11.

For the sake of completeness only, it is shown in FIG. 12 that the embodiments of encoder 100 and decoder 130 of FIGS. 9 and 11 may be varied in that the juxtaposition between scale factors on the one hand and scale factor specific noise levels is differently implemented. In accordance with the example of FIG. 12, the encoder transmits within the data stream information of a noise envelope, spectrotemporally sampled at a resolution coarser than the spectral line-wise resolution of spectrogram 12, such as, for example, at the same spectrotemporal resolution as the scale factors 112, in addition to the scale factors 112. This noise envelope information is indicated using reference sign 140 in FIG. 12. By this measure, for scale factor bands not completely quantized to zero two values exist: a scale factor for rescaling or dequantizing the non-zero spectral values within that respective scale factor band, as well as a noise level 140 for scale factor band individual scaling the noise level of the zero-quantized spectral values within that scale factor band. This concept is sometimes called IGF (Intelligent Gap Filling).

Even here, the noise filler 30 may apply the tonality dependent filling of the contiguous spectral zero-portions 40*a* to 40*d* exemplarily as shown in FIG. 12.

Figure 13:
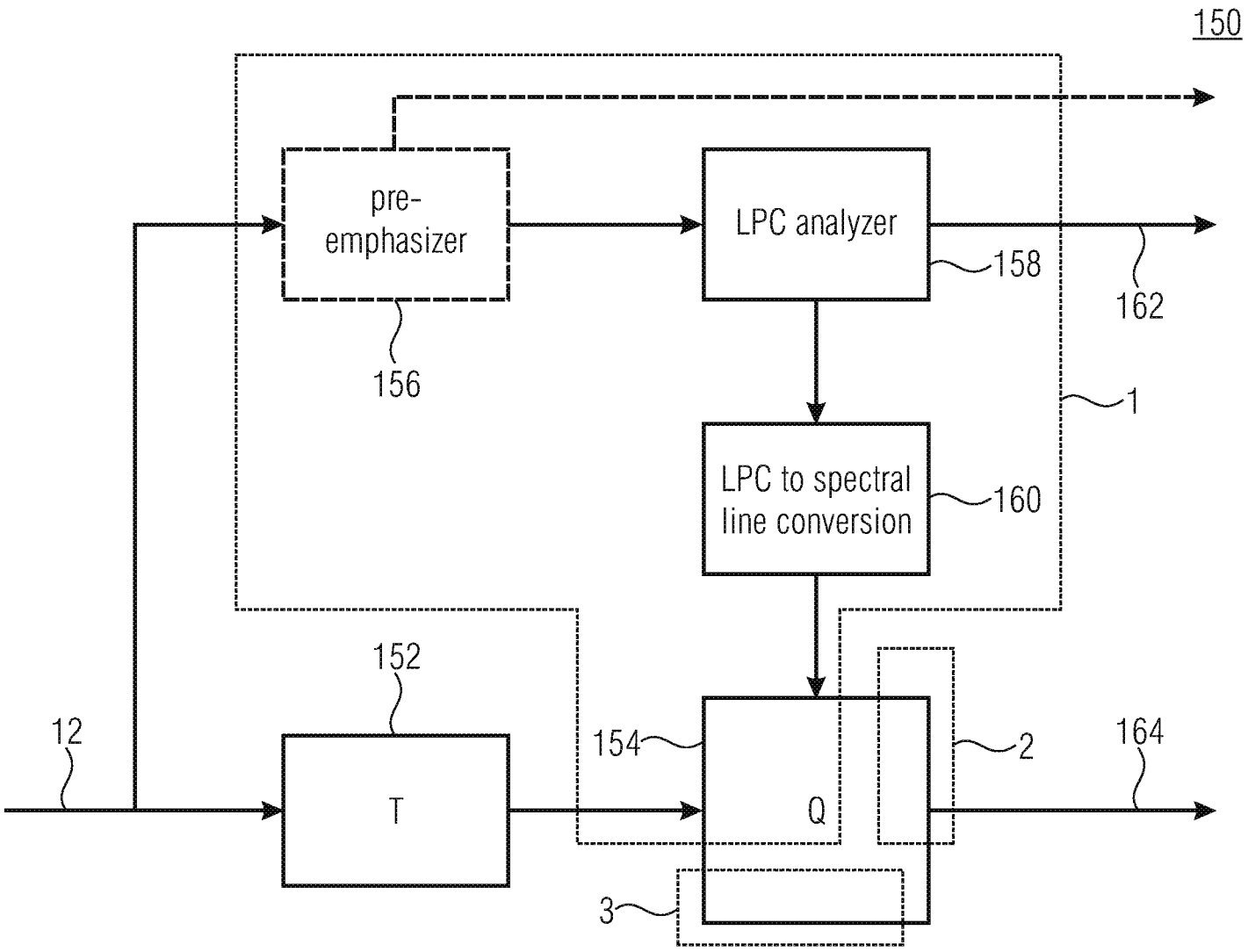
FIG. 13 shows a linear predictive transform audio encoder which may be included in an audio codec using the noise filling concept of FIGS. 1 to 8 in accordance with an embodiment.
Figure 14:
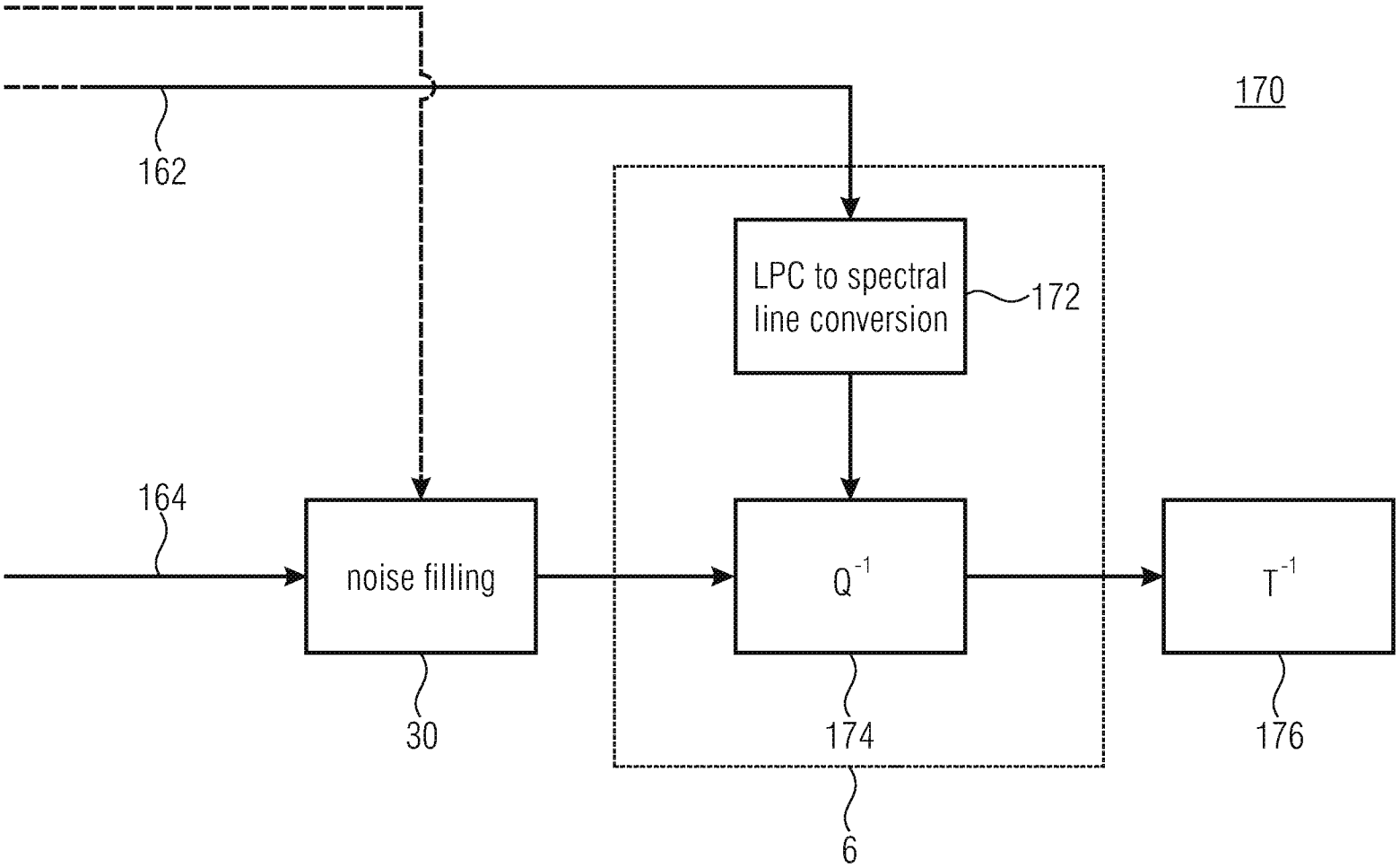
FIG. 14 shows a block diagram of a decoder fitting to the encoder of FIG. 13.

In accordance with the audio codec examples outlined above with respect to FIGS. 9 to 12, the spectral shaping of the quantization noise has been performed by transmitting an information concerning the perceptual masking threshold using a spectrotemporal representation in the form of scale factors. FIGS. 13 and 14 show a pair of encoder and decoder where also the noise filling embodiments described with respect to FIGS. 1 to 8 may be used, but where the quantization noise is spectrally shaped in accordance with an LP (Linear Prediction) description of the audio signal's spectrum. In both embodiments, the spectrum to be noise filled is in the weighted domain, i.e. it is quantized using a spectrally constant step size in the weighted domain or perceptually weighted domain.

FIG. 13 shows an encoder 150 which comprises a transformer 152, a quantizer 154, a pre-emphasizer 156, an LPC analyzer 158, and a LPC-to-spectral-line-converter 160. The pre-emphasizer 156 is optional. The pre-emphasizer 156 subjects the inbound audio signal 12 to a pre-emphasis, namely a high pass filtering with a shallow high pass filter transfer function using, for example, a FIR or IIR filter. An first-order high pass filter may, for example, be used for pre-emphasizer 156 such as $H(z)=1-\alpha z-1$ with $\alpha$ setting, for example, the amount or strength of pre-emphasis in line with which, in accordance with one of the embodiments, the spectrally global tilt to which the noise for being filled into the spectrum is subject, is varied. A possible setting of $\alpha$ could be 0.68. The pre-emphasis caused by pre-emphasizer 156 is to shift the energy of the quantized spectral values transmitted by encoder 150, from a high to low frequencies, thereby taking into account psychoacoustic laws according to which human perception is higher in the low frequency region than in the high frequency region. Whether or not the audio signal is pre-emphasized, the LPC analyzer 158 performs an LPC analysis on the inbound audio signal 12 so as to linearly predict the audio signal or, to be more precise, estimate its spectral envelope. The LPC analyzer 158 determines in time units of, for example, sub-frames consisting of a number of audio samples of audio signal 12, linear prediction coefficients and transmit same as shown at 162 to the decoding side within the data stream. The LPC analyzer 158 determines, for example, the linear prediction coefficients using autocorrelation in analysis windows and using, for example, a Levinson-Durbin algorithm. The linear prediction coefficients may be transmitted in the data stream in a quantized and/or transformed version such as in the form of spectral line pairs or the like. In any case, the LPC analyzer 158 forwards to the LPC-to-spectral-line-converter 160 the linear prediction coefficients as also available at the decoding side via the data stream, and the converter 160 converts the linear prediction coefficients into a spectral curve used by quantizer 154 to spectrally vary/set the quantization step size. In particular, transformer 152 subjects the inbound audio signal 12 to a transformation such as in the same manner as transformer 104 does. Thus, transformer 152 outputs a sequence of spectrums and quantizer 154 may, for example, divide each spectrum by the spectral curve obtained from converter 160 with then using a spectrally constant quantization step size for the whole spectrum. The spectrogram of a sequence of spectrums output by quantizer 154 is shown at 164 in FIG. 13 and comprises also some contiguous spectral zero-portions which may be filled at the decoding side. A global noise level parameter may be transmitted within the data stream by encoder 150.

FIG. 14 shows a decoder fitting to the encoder of FIG. 13. The decoder of FIG. 14 is generally indicated using reference sign 170 and comprises a noise filler 30, an LPC-to-spectral-line-converter 172, a dequantizer 174 and an inverse transformer 176. The noise filler 30 receives the quantized spectrums 164, performs the noise filling onto the contiguous spectral zero-portions as described above, and forwards the thus filled spectrogram to dequantizer 174.

The dequantizer 174 receives from the LPC-to-spectral-line converter 172 a spectral curve to be used by dequantizer 174 for reshaping the filled spectrum or, in other words, for dequantizing it. This process is sometimes called FDNS (Frequency Domain Noise Shaping). The LPC-to-spectral-line-converter 172 derives the spectral curve on the basis of the LPC information 162 in the data stream. The dequantized spectrum, or reshaped spectrum, output by dequantizer 174 is subject to an inverse transformation by inverse transformer 176 in order to recover the audio signal. Again, the sequence of reshaped spectrums may be subject by inverse transformer 176 to an inverse transformation followed by an overlap-add-process in order to perform time-domain aliasing cancellation between consecutive retransforms in case of the transformation of transformer 152 being a critically sampled lapped transform such as MDCT.

By way of dotted lines in FIGS. 13 and 14 it is shown that the pre-emphasis applied by pre-emphasizer 156 may vary in time, with a variation being signaled within the data stream. The noise filler 30 may, in that case, take into account the pre-emphasis when performing the noise filling as described above with respect to FIG. 8. In particular, the pre-emphasis causes a spectral tilt in the quantized spectrum output by quantizer 154 in that the quantized spectral values, i.e. the spectral levels, tend to decrease from lower frequencies to higher frequencies, i.e. they show a spectral tilt. This spectral tilt may be compensated, or better emulated or adapted to, by noise filler 30 in the manner described above. If signaled in the data stream, the degree of pre-emphasis signaled may be used to perform the adaptive tilting of the filled-in noise in a manner dependent on the degree of pre-emphasis. That is, the degree of pre-emphasis signaled in the data stream may be used by the decoder to set the degree of spectral tilt imposed onto the noise filled into the spectrum by noise filler 30.

Up to now, several embodiments have been described, and hereinafter specific implementation examples are presented. The details brought forward with respect to these examples, shall be understood as being individually transferrable onto the above embodiments to further specify same. Before that, however, it should be noted that all of the embodiments described above may be used in audio as well as speech coding. They generally refer to transform coding and use a signal adaptive concept for replacing the zeros introduced in the quantization process with spectrally shaped noise using very small amount of side information. In the embodiments described above, the observation has been exploited that spectral holes sometimes also appear just below a noise filling starting frequency if any such starting frequency is used, and that such spectral holes are sometimes perceptually annoying. The above embodiments using an explicit signaling of the starting frequency allow for removing the holes that bring degradation but allow for avoiding to insert noise at low frequencies wherever the insertion of noise would introduce distortions.

Moreover, some of the embodiments outlined above use a pre-emphasis controlled noise filing in order to compensate for the spectral tilt caused by the pre-emphasis. These embodiments take into account the observance that if the LPC filter is calculated on a pre-emphasis signal, merely applying a global or average magnitude or average energy of the noise to be inserted would cause the noise shaping to introduce a spectral tilt in the inserted noise as the FDNS at the decoding side would subject the spectrally flat inserted noise to a spectral shaping still showing the spectral tilt of the pre-emphasis. Accordingly, the latter embodiments performed a noise filling in such a manner that the spectral tilt from the pre-emphasis is taken into account and compensated.

Thus, in other words, FIGS. 11 and 14 each showed a perceptual transform audio decoder. It comprises a noise filler 30 configured to perform noise filling on a spectrum 18 of an audio signal. The performance may be done tonality dependent as described above. The performance may be done by filling the spectrum with noise exhibiting a spectrally global tilt so as to obtain a noise-filled spectrum, as described above. "Spectrally global tilt" shall, for example, mean that the tilt manifests itself for example, in an envelope enveloping the noise across all portions 40 to be filled with noise, which is inclined i.e. has a non-zero slope. "Envelope" is, for example, defined to be a spectral regression curve such as a linear function or another polynom of order two or three, fer example, leading through the local maxima of the noise filled into the portion 40 which are all self-contiguous, but spectrally distanced. "decreasing from low to high frequencies" means that this inclination is has a negative slope, and "increasing from low to high frequencies" means that this inclination is has a positive slope. Both performance aspects may apply concurrently or merely one of them.

Further, the perceptual transform audio decoder comprises a frequency domain noise shaper 6 in form of dequantizer 132, 174, configured to subject the noise-filled spectrum to spectral shaping using a spectral perceptual weighting function. In case of FIG. 11, the frequency domain noise shaper 132 is configured to determine the spectral perceptual weighting function from linear prediction coefficient information 162 signaled in the data stream into which the spectrum is coded. In case of FIG. 14, the frequency domain noise shaper 174 is configured to determine the spectral perceptual weighting function from scale factors 112 relating to scale factor bands 110, signaled in the data stream. As described with regard to FIG. 8 and illustrated with respect to FIG. 11, the noise filler 34 may be configured to vary a slope of the spectrally global tilt responsive to an explicit signaling in the data stream, or deduce same from a portion of the data stream which signals the spectral perceptual weighting function such as by evaluating the LPC spectral envelope or the scale factors, or deduce same from the quantized and transmitted spectrum 18.

Further, the perceptual transform audio decoder comprises an inverse transformer 134, 176 configured to inversely transform the noise-filled spectrum, spectrally shaped by the frequency domain noise shaper, to obtain an inverse transform, and subject the inverse transform to an overlap-add process.

Correspondingly, FIGS. 13 and 9 both showed examples for a perceptual transform audio encoder configured to perform a spectrum weighting 1 and quantization 2 both implemented in the quantizer modules 108, 154 shown in FIGS. 9 and 13. The spectrum weighting 1 spectrally weights an audio signal's original spectrum according to an inverse of a spectral perceptual weighting function so as to obtain a perceptually weighted spectrum, and the quantization 2 quantizes the perceptually weighted spectrum in a spectrally uniform manner so as to obtain a quantized spectrum. The perceptual transform audio encoder further performs a noise level computation 3 within the quantization modules 108, 154, for example, computing a noise level parameter by measuring a level of the perceptually weighted spectrum co-located to zero-portions of the quantized spectrum in a manner weighted with a spectrally global tilt increasing from low to high frequencies. In accordance with FIG. 13, the perceptual transform audio encoder comprises an LPC analyser 158 configured to determine linear prediction coefficient information 162 representing an LPC spectral envelope of the audio signal's original spectrum, wherein the spectral weighter 154 is configured to determine the spectral perceptual weighting function so as to follow the LPC spectral envelope. As described, the LPC analyser 158 may be configured to determine the linear prediction coefficient information 162 by performing LP analysis on a version of the audio signal, subject to a pre-emphasis filter 156. As described above with respect to FIG. 13, the pre-emphasis filter 156 may be configured to high-pass filter the audio signal with a varying pre-emphsis amount so as to obtain the version of the audio signal, subject to a pre-emphasis filter, wherein the noise level computation may be configured to set an amount of the spectrally global tilt depending on the pre-emphasis amount. Explicitly signaling of the amount of the spectrally global tilt or the pre-emphasis amount in the data stream may be used. In case of FIG. 9, the perceptual transform audio encoder comprises an scale factor determination, controlled via a perceptual model 106, which determines scale factors 112 relating to scale factor bands 110 so as to follow a masking threshold. This determination is implemented in quantization module 108, for example, which also acts as the spectral weighter configured to determine the spectral perceptual weighting function so as to follow the scale factors.

Figure 18A:
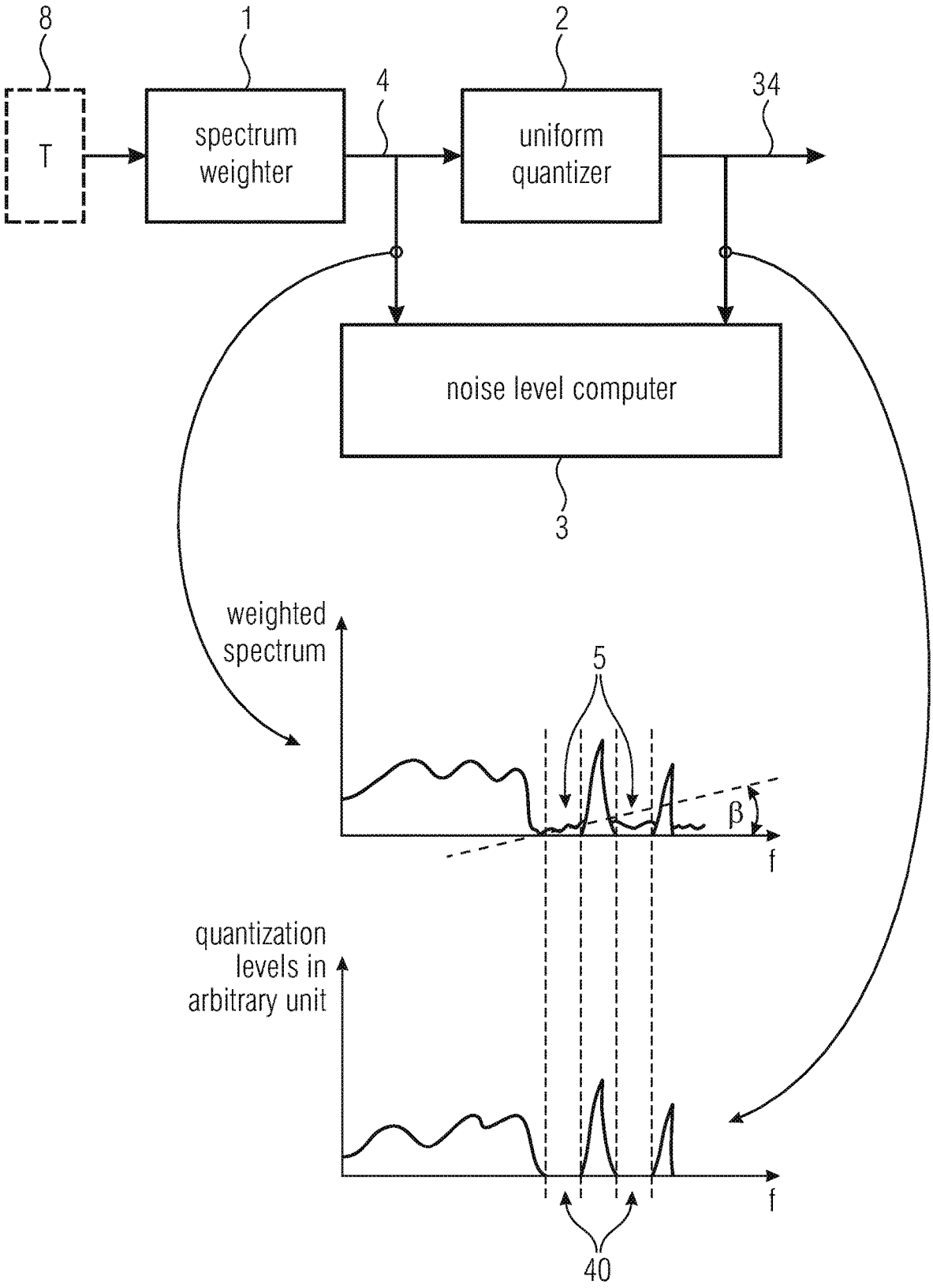
FIG. 18*a* shows a block diagram of a perceptual transform audio encoder in accordance with an embodiment.
Figure 18B:
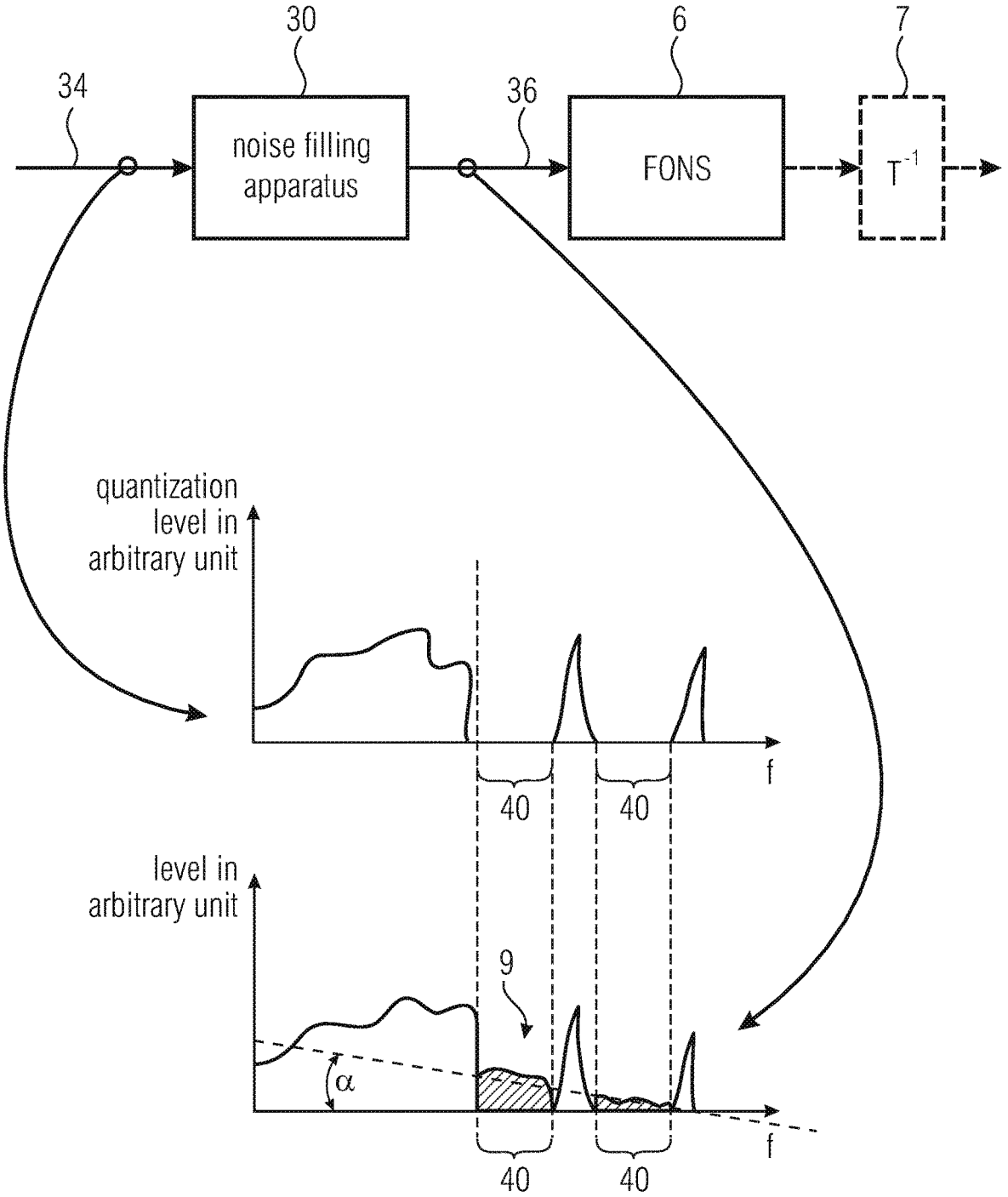
FIG. 18*b* shows a block diagram of a perceptual transform audio decoder in accordance with an embodiment.

The just-applied alternative and generalizing wording used to describe FIGS. 9 to 14 is picked-up now to describe FIGS. 18*a* and 18*b*.

FIG. 18*a* shows a perceptual transform audio encoder in accordance with an embodiment of the present application, and FIG. 18*b* shows a perceptual transform audio decoder in accordance with an embodiment of the present application, both fitting together so as to form a perceptual transform audio codec.

As shown in FIG. 18*a*, the perceptual transform audio encoder comprises a spectrum weighter 1 configured to spectrally weight an audio signal's original spectrum received by the spectrum weighter 1 according to an inverse of a spectral weighting perceptual weighting function determined by spectrum weighter 1 in a predetermined manner for which examples are shown hereinafter. The spectral weighter 1 obtains, by this measure, a perceptually weighted spectrum, which is then subject to quantization in a spectrally uniform manner, i.e. in a manner equal for the spectral lines, in a quantizer 2 of the perceptual transform audio encoder. The result output by uniform quantizer 2 is a quantized spectrum 34 which finally is coded into a data stream output by the perceptual transform audio encoder.

In order to control noise filling to be performed at the decoding side so as to improve the spectrum 34, with regard to setting the level of the noise, a noise level computer 3 of the perceptual transform audio encoder may optionally be present which computes a noise level parameter by measuring a level of the perceptually weighted spectrum 4 at portions 5 co-located to zero-portions 40 of the quantized spectrum 34. The noise level parameter thus computed may also coded in the aforementioned data stream so as to arrive at the decoder.

The perceptual transform audio decoder is shown in FIG. 18*b*. Same comprises a noise filling apparatus 30 configured to perform noise filling on the inbound spectrum 34 of the audio signal, as coded into the data stream generated by the encoder of FIG. 1*a*, by filling the spectrum 34 with noise exhibiting a spectrally global tilt so that the noise level decreases from low to high frequencies so as to obtain a noise filled spectrum 36. A noise frequency domain noise shaper of the perceptual transform audio decoder, indicated using reference sign 6, is configured to subject the noise filled spectrum to spectral shaping using the spectral perceptual weighting function obtained from the encoding side via the data stream in a manner described by specific examples further below. This spectrum output by frequency domain noise shaper 6 may be forwarded to an inverse transformer 7 in order to reconstruct the audio signal in the time-domain and likewise, within the perceptual transform audio encoder, a transformer 8 may precede spectrum weighter 1 in order to provide the spectrum weighter 1 with the audio signal's spectrum.

The significance of filling spectrum 34 with noise 9 which exhibits a spectrally global tilt is the following: later, when the noise filled spectrum 36 is subject to the spectral shaping by frequency domain noise shaper 6, spectrum 36 will be subject to a tilted weighting function. For example, the spectrum will be amplified at the high frequencies when compared to a weighting of the low frequencies. That is, the level of spectrum 36 will be raised at higher frequencies relative to lower frequencies. This causes a spectrally global tilt with positive slope in originally spectrally flat portions of spectrum 36. Accordingly, if noise 9 would be filled into spectrum 36 so as to fill the zero-portions 40 thereof, in a spectrally flat manner, then the spectrum output by FDNS 6 would show within these portions 40 a noise floor which tends to increase from, for example, low to high frequencies. That is, when examining the whole spectrum or at least the portion of the spectrum bandwidth, where noise filling is performed, one would see that the noise within portions 40 has a tendency or linear regression function with positive slope or negative slope. As noise filling apparatus 30, however, fills spectrum 34 with noise exhibiting a spectrally global tilt of positive or negative slope, indicated a in FIG. 1*b*, and being inclined into opposite direction compared to the tilt caused by the FDNS 9, the spectral tilt caused by the FDNS 6 is compensated for and the noise floor thus introduced into the finally reconstructed spectrum at the output of FDNS 6 is flat or at least more flat, thereby increasing the audio quality be leaving less deep noise holes.

"Spectrally global tilt" shall denote that the noise 9 filled into spectrum 34 has a level which tends to decrease (or increase) from low to high frequencies. For example, when placing a linear regression line through local maxima of noise 9 as filled into, for example, mutually spectrally distanced, contiguous spectral zero portions 40, the resulting linear regression line has the negative (or positive) slope $\alpha$.

Although not mandatory, the perceptual transform audio encoder's noise level computer may account for the tilted way of filling noise into spectrum 34 by measuring the level of the perceptually weighted spectrum 4 at portions 5 in a manner weighted with a spectrally global tilt having, for example, a positive slope in case of a being negative and negative slope if $\alpha$ is positive. The slope applied by the noise level computer, which is indicated as $\beta$ in FIG. 18*a*, does not have to be the same as the one applied at the decoding side as far as the absolute value thereof is concerned, but in accordance with an embodiment this might be the case. By doing so, the noise level computer 3 is able to adapt the level of the noise 9 inserted at the decoding side more precisely to the noise level which approximates the original signal in a best way and across the whole spectral bandwidth.

Later on it will be described that it may be feasible to control a variation of a slope of the spectrally global tilt a via explicit signaling in the data stream or via implicit signaling in that, for example, the noise filling apparatus 30 deduces the steepness from, for example, the spectral perceptual weighting function itself or from a transform window length switching. By the letter deduction, for example, the slope may be adapted to the window length.

Figure 18C:
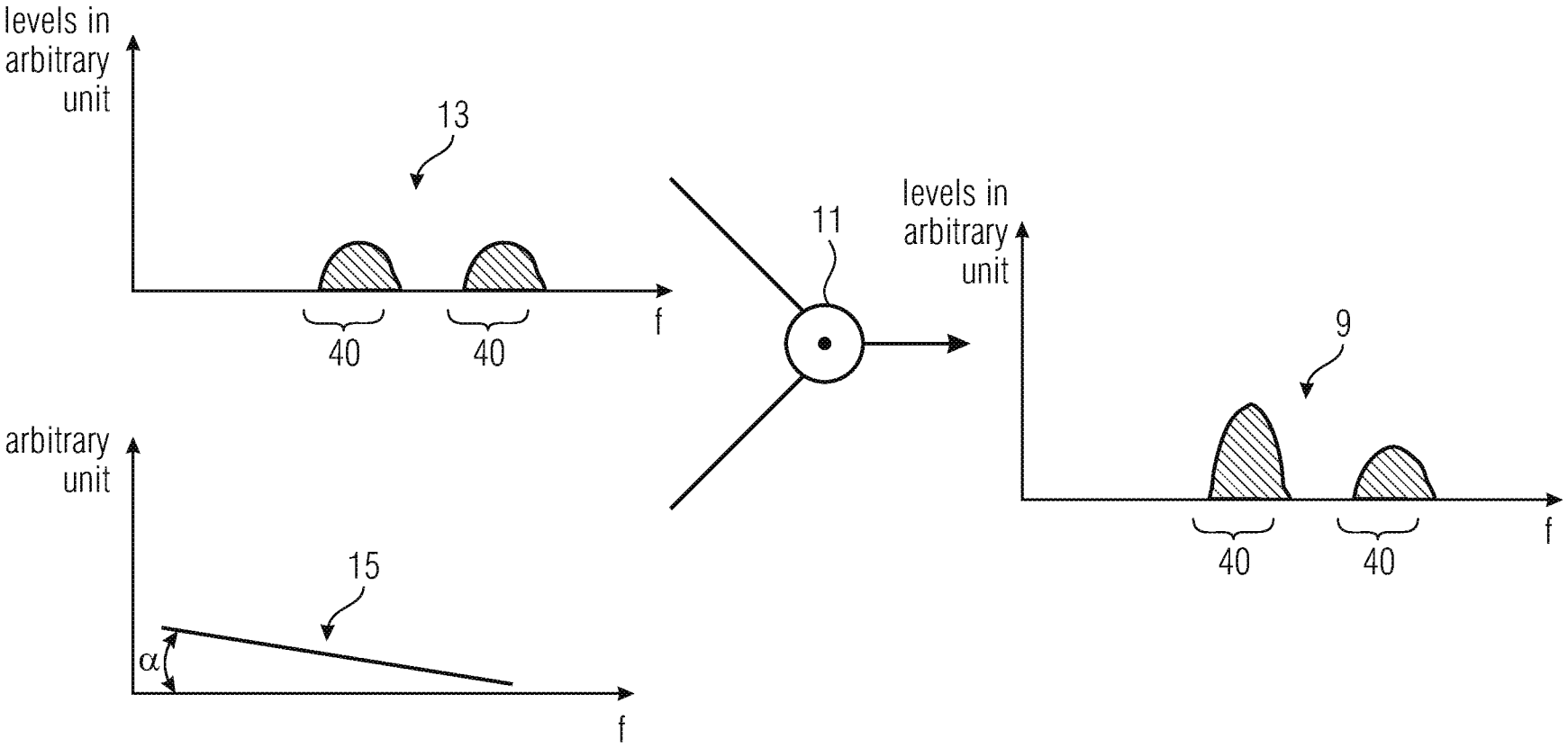
FIG. 18*c* shows a schematic diagram illustrating a possible way of achieving the spectrally global tilt introduced into the noise filled-in in accordance with an embodiment.

There are different manners feasible by way of which noise filling apparatus 30 causes the noise 9 to exhibit the spectrally global tilt. FIG. 18*c*, for example, illustrates that the noise filling apparatus 30 performs a spectral line-wise multiplication 11 between an intermediary noise signal 13, representing an intermediary state in the noise filling process, and a monotonically decreasing (or increasing) function 15, i.e. a function which monotonically spectrally decreases (or increases) across the whole spectrum or at least the portion where noise filling is performed, to obtain the noise 9. As illustrated in FIG. 18*c*, the intermediary noise signal 13 may be already spectrally shaped. Details in this regard pertains to specific embodiments outlined further below, according to which the noise filling is also performed dependent on the tonality. The spectral shaping, however, may also be left out or may be performed after multiplication 11. The noise level parameter signal and the data stream may be used to set the level of the intermediary noise signal 13, but alternatively the intermediary noise signal may be generated using a standard level, applying the scalar noise level parameter so as to scale the spectrum line after multiplication 11. The monotonically decreasing function 15 may, as illustrated in FIG. 18*c*, be a linear function, a piece-wise linear function, a polynomial function or any other function.

As will be described in more detail below, it would be feasible to adaptively set the portion of the whole spectrum within which noise filling is performed by noise filling apparatus 30.

In connection with the embodiments outlined further below, according to which contiguous spectral zero-portions in spectrum 34, i.e. spectrum holes, are filled in a specific non-flat and tonality dependent manner, it will be explained that there are also alternatives for the multiplication 11 illustrated in FIG. 18*c* in order to provoke the spectrally global tilt discussed so far.

All of the embodiments described above have in common that spectrum holes are avoided and that also concealing of tonal non-zero quantized lines is avoided. In the manner described above, the energy in noisy parts of a signal may be preserved and the adding of noise that masked tonal components is avoided in a manner described above.

In the specific implementations described below, the part of the side information for performing the tonality dependent noise filling does not add anything to the existing side information of the codec where the noise filling is used. All information from the data stream that is used for the reconstruction of the spectrum, regardless of the noise filling, may also be used for the shaping of the noise filling.

Figure 15:
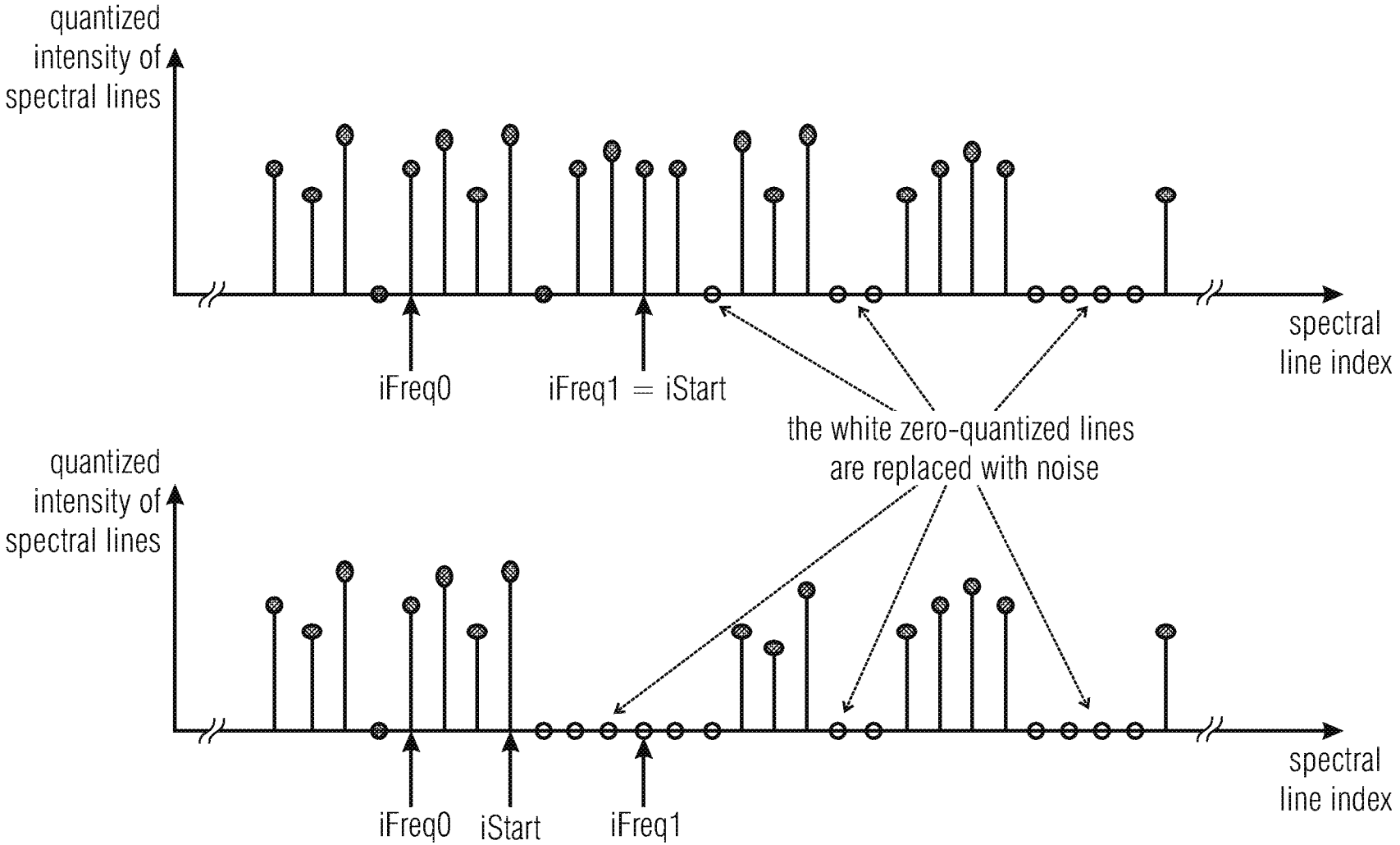
FIG. 15 shows examples of fragments out of a spectrum to be noise filled.

In accordance with an implementation example, the noise filling in noise filler 30 is performed as follows. All spectral lines above a noise filling start index that are quantized to zero are replaced with a non-zero value. This is done, for example, in a random or pseudorandom manner with spectrally constant probability density function or using patching from other spectral spectrogram locations (sources). See, for example, FIG. 15. FIG. 15 shows two examples for a spectrum to be subject to a noise filling just as the spectrum 34 or the spectrums 18 in spectrogram 12 output by quantizer 108 or the spectrums 164 output by quantizer 154. The noise filling start index is a spectral line index between iFreq0 and iFreq1 (0<iFreq0<=iFreq1), where iFreq0 and iFreq1 are predetermined, bitrate and bandwidth dependent spectral line indices. The noise filling start index is equal to the index iStart (iFreq0<=iStart<=iFreq1) of a spectral line quantized to a non-zero value, where all spectral lines with indices j (iStart<j<=Freq1) are quantized to zero. Different values for iStart, iFreq0 or iFreq1 could also be transmitted in the bitstream to allow inserting very low frequency noise in certain signals (e.g. environmental noise).

The inserted noise is shaped in the following steps:

1. In the residual domain or weighted domain. The shaping in the residual domain or weighted domain has been extensively described above with respect to FIGS. 1-14.
2. Spectral shaping using an LPC or the FDNS (shaping in the transform domain using the LPC's magnitude response) has been described with respect to FIGS. 13 and 14. The spectrum also may be shaped using scale factors (as in AAC) or using any other spectral shaping method for shaping the complete spectrum as described with respect to FIGS. 9-12.
3. Optional shaping using TNS (Temporal Noise Shaping) using a smaller number of bits, has been described briefly with respect to FIGS. 9-12.

The only additional side info needed for the noise filling is the level, which is transmitted using 3 bits, for example.

When using FDNS there is no need to adapt it to a specific noise filling and it shapes the noise over the complete spectrum using smaller number of bits than the scale factors.

A spectral tilt may be introduced in the inserted noise to counteract the spectral tilt from the pre-emphasis in the LPC-based perceptual noise shaping. Since the pre-emphasis represents a gentle high-pass filter applied to the input signal, the tilt compensation may counteract this by multiplying the equivalent of the transfer function of a subtle low-pass filter onto the inserted noise spectrum. The spectral tilt of this low-pass operation is dependent on the pre-emphasis factor and, advantageously, bit-rate and bandwidth. This was discussed referring to FIG. 8.

Figure 16:
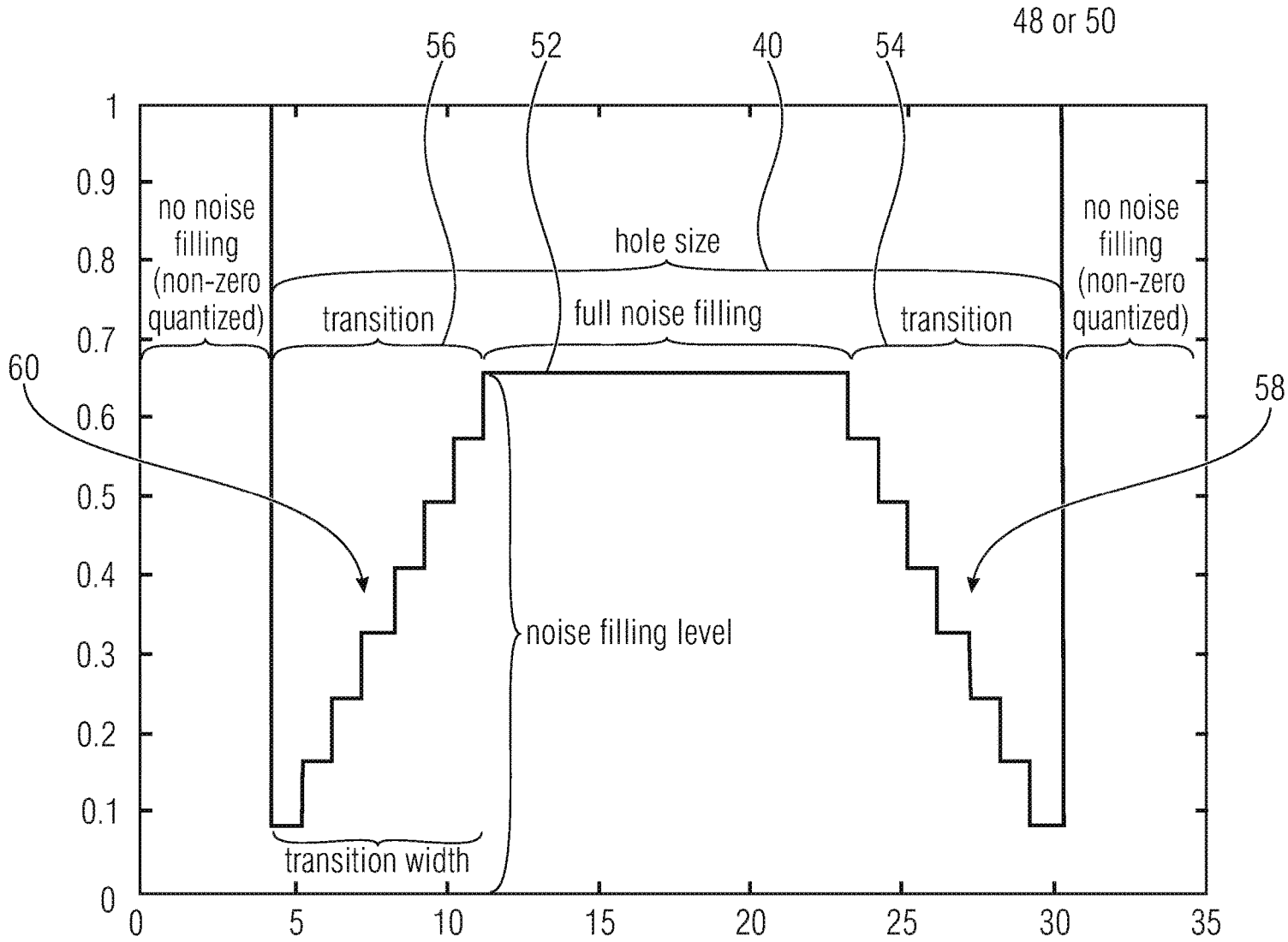
FIG. 16 shows an explicit example for a function for shaping the noise filled into a certain contiguous spectral zero-portion of the spectrum to be noise filled in accordance with an embodiment.
Figure 17A:
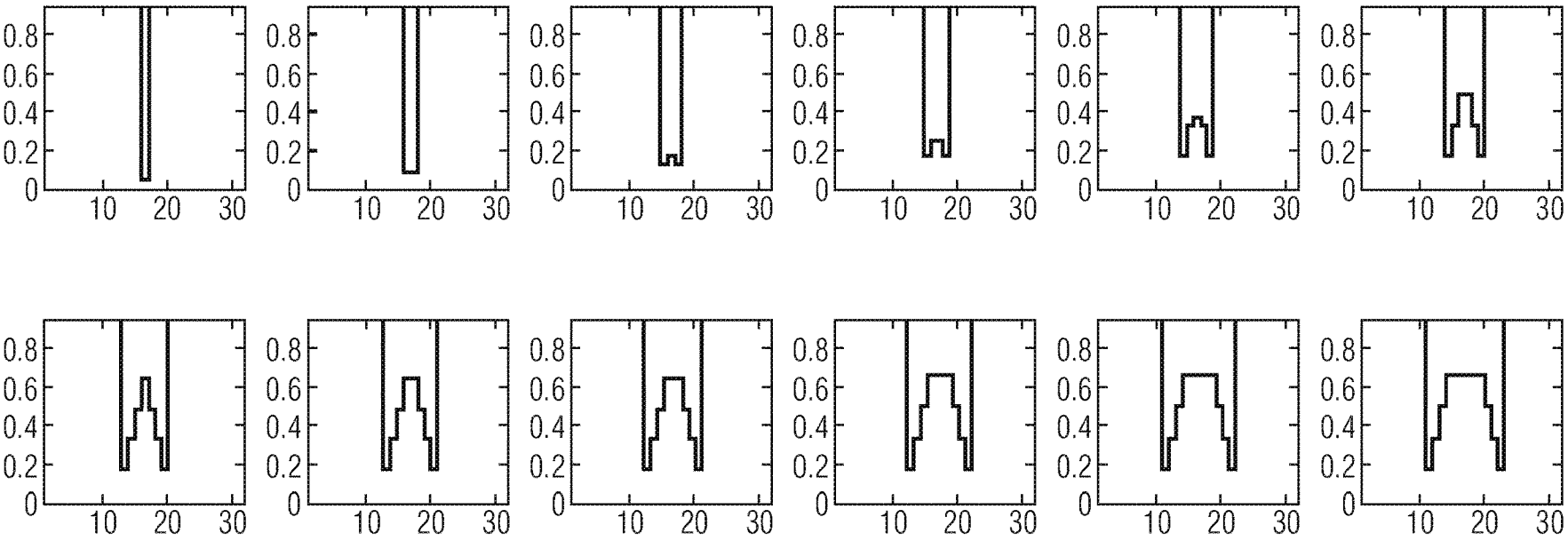
FIGS. 17*a*-17*d* show various examples for functions for spectrally shaping the noise filled into contiguous spectral zero-portions for different zero-portions widths and different transition widths used for different tonalities.
Figure 17B:
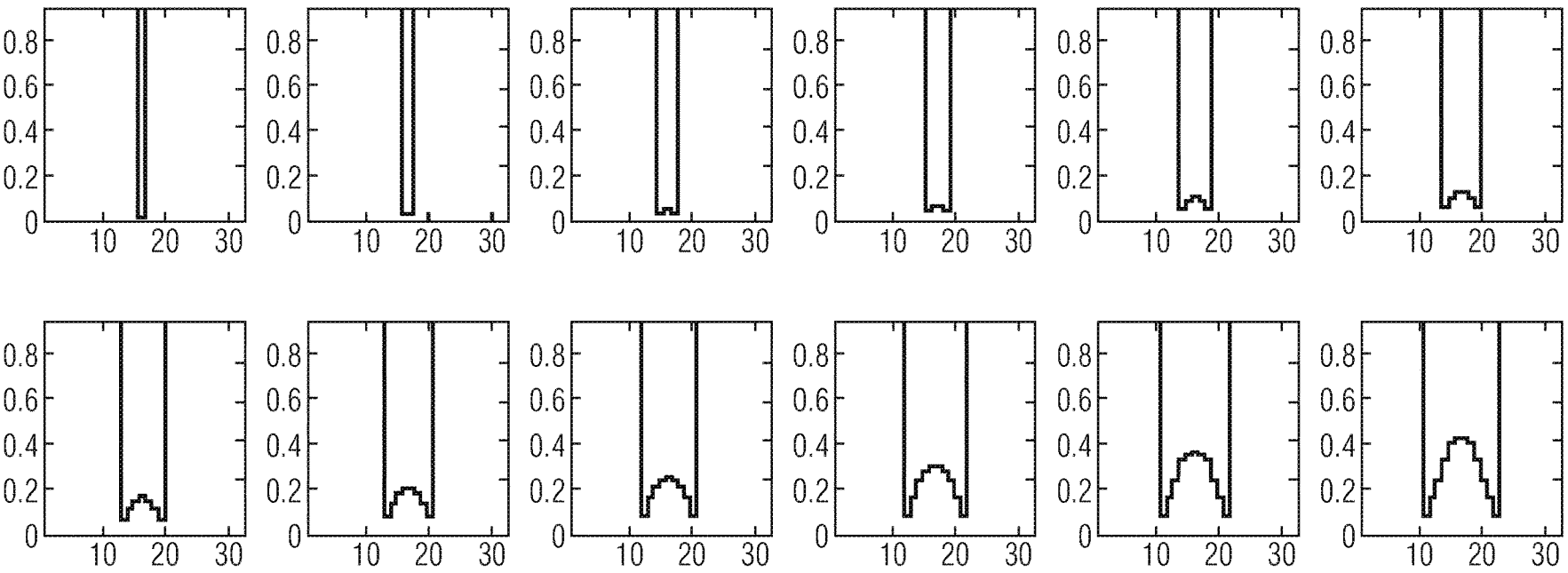
Figure 17C:
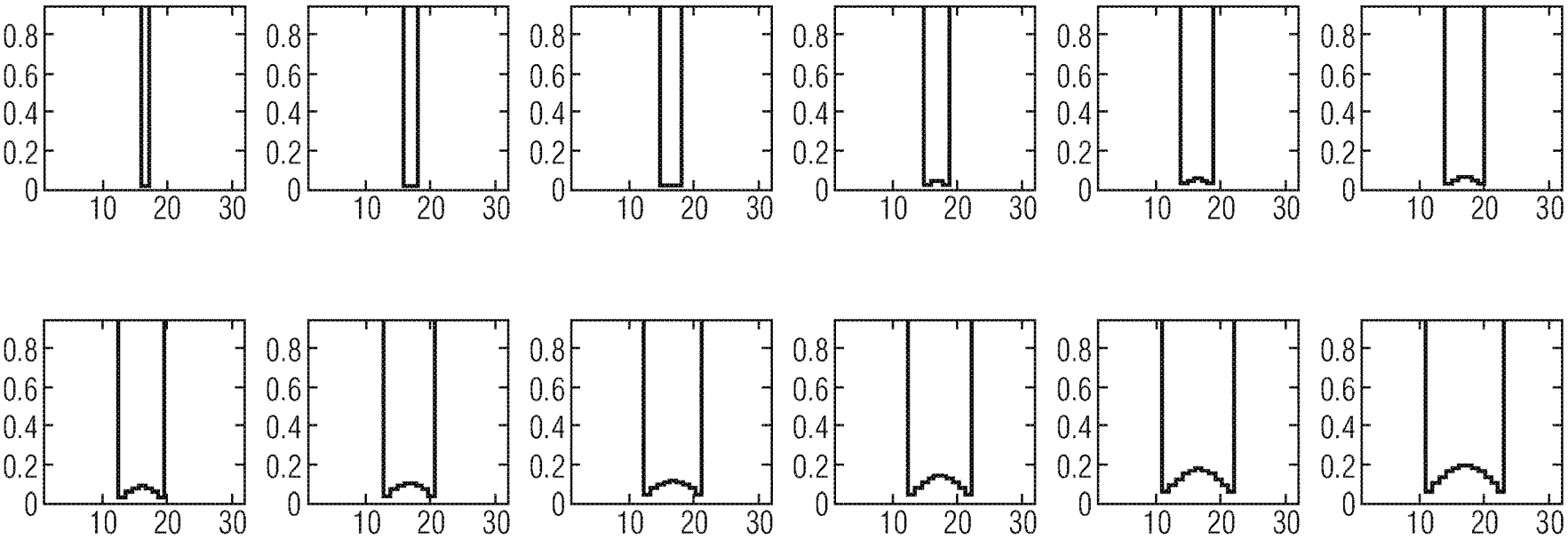
Figure 17D:
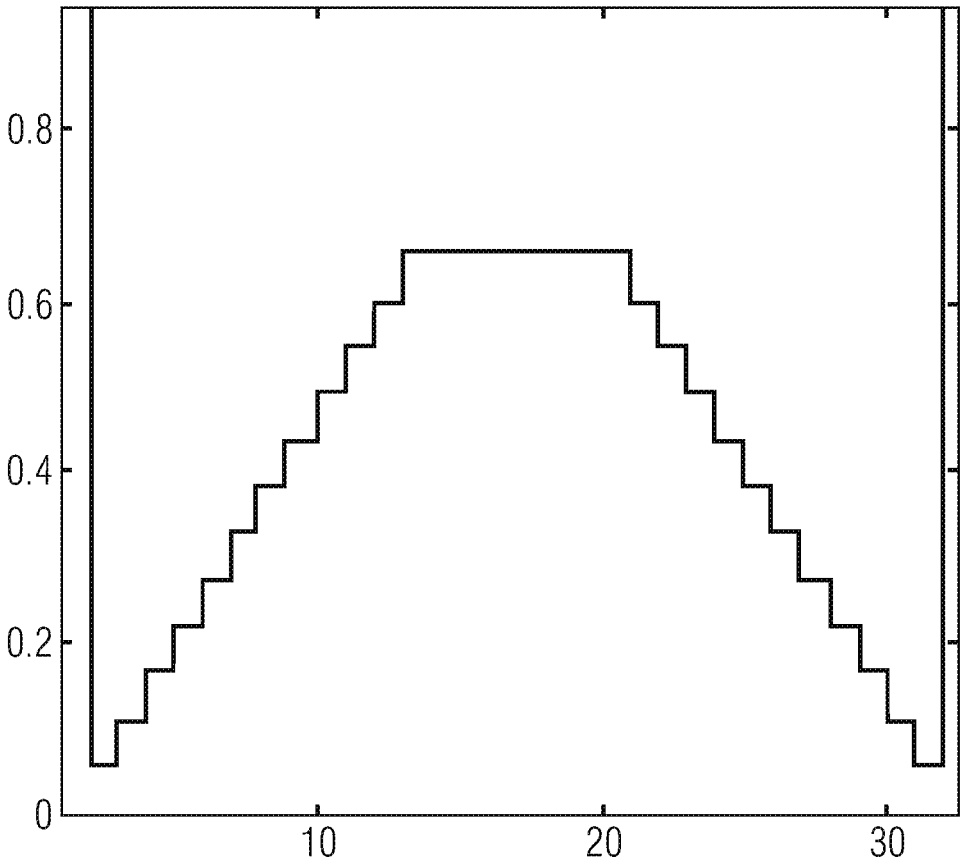

For each spectral hole, constituted from 1 or more consecutive zero-quantized spectral lines, the inserted noise may be shaped as depicted in FIG. 16. The noise filling level may be found in the encoder and transmitted in the bitstream. There is no noise filling at non-zero quantized spectral lines and it increases in the transition area up to the full noise filling. In the area of the full noise filling the noise filling level is equal to the level transmitted in the bit-stream, for example. This avoids inserting high level of noise in the immediate neighborhood of a non-zero quantized spectral lines that could potentially mask or distort tonal components. However all zero-quantized lines are replaced with a noise, leaving no spectrum holes.

The transition width is dependent on the tonality of the input signal. The tonality is obtained for each time frame. In FIGS. 17*a*-17*d* the noise filling shape is exemplarily depicted for different hole sizes and transition widths.

The tonality measure of the spectrum may be based on the information available in the bitstream:

LTP gain

Spectrum rearrangement enabled flag (see [6])

TNS enabled flag

The transition width is proportional to the tonality—small for noise like signals, big for very tonal signals.

In an embodiment, the transition width is proportional to the LTP gain if the LTP gain>0. If the LTP gain is equal to 0 and the spectrum rearrangement is enabled then the transition width for the average LTP gain is used. If the TNS is enabled then there is no transition area, but the full noise filling should be applied to all zero-quantized spectral lines. If the LTP gain is equal to 0 and the TNS and the spectrum rearrangement are disabled, a minimum transition width is used.

If there is no tonality information in the bitstream a tonality measure may be calculated on the decoded signal without the noise filling. If there is no TNS information, a temporal flatness measure may be calculated on the decoded signal. If, however, TNS information is available, such a flatness measure may be derived from the TNS filter coefficients directly, e.g. by computing the filter's prediction gain.

In the encoder, the noise filling level may be calculated by taking the transition width into account. Several ways to determine the noise filling level from the quantized spectrum are possible. The simplest is to sum up the energy (square) of all lines of the normalized input spectrum in the noise filling region (i.e. above iStart) which were quantized to zero, then to divide this sum by the number of such lines to obtain the average energy per line, and to finally compute a quantized noise level from the square root of the average line energy. In this way, the noise level is effectively derived from the RMS of the spectral components quantized to zero. Let, for example, A be the set of indices i of spectral lines where the spectrum has been quantized to zero and which belong to any of the zero-portions, e.g. is above start frequency, and let N denote the global noise scaling factor. The values of the spectrum as not yet quantized shall be denoted $y_i$. Further, left(i) shall be a function indicating for any zero-quantized spectral value at index i the index of the zero-quantized value at the low-frequency end of the zero-portion to which i belongs, and $F_i(j)$ with j=0 to $J_i-1$ shall denote the function assigned to, depending on the tonality, the zero-portion starting at index i, with $J_i$ indicating the width of that zero-portion. Then, N may be determined by $N=\mathrm{sqrt}(\Sigma_{i\in A} y_i^2/\mathrm{cardinality}(A))$.

In the embodiment, the individual hole sizes as well as the transition width are considered. To this end, runs of consecutive zero-quantized lines are grouped into hole regions. Each normalized input spectral line in a hole region, i.e. each spectral value of the original signal at a spectral position within any contiguous spectral zero-portion, is then scaled by the transition function, as described in the previous section, and subsequently the sum of the energies of the scaled lines is calculated. Like in the previous simple embodiment, the noise filling level can then be computed from the RMS of the zero-quantized lines. Applying the above nomenclature, N may be computed as by $N=\mathrm{sqrt}(\Sigma_{i\in A}(F_{left(i)}(i-\mathrm{left}(i))\cdot y_i)^2/\mathrm{cardinality}(A))$.

A problem with this approach, however, is that the spectral energy in small hole regions (i.e. regions with a width of much less than twice the transition width) is underestimated since in the RMS calculation, the number of spectral lines in the sum by which the energy sum is divided is unchanged. In other words, when the quantized spectrums exhibits mostly many small hole regions, the resulting noise filling level will be lower than when the spectrum is sparse and has only a few long hole regions. To ensure that in both of these cases a similar noise level is found, it is therefore advantageous to adapt the line-count used in the denominator of the RMS computation to the transition width. Most importantly, if a hole region size is smaller than twice the transition width, the number of spectral lines in that hole region is not counted as-is, i.e. as an integer number of lines, but as a fractional line-number which is less than the integer line-number. In the above formula concerning N, for example, the "cardinality(A)" would be replaced by a smaller number depending on the number of "small" zero-portions.

Furthermore, the compensation of the spectral tilt in the noise filling due to the LPC-based perceptual coding should also be taken into account during the noise level calculation. More specifically, the inverse of the decoder-side noise filling tilt compensation is applied to the original unquantized spectral lines which were quantized to zero, before the noise level is computed. In the context of LPC-based coding employing pre-emphasis, this implies that higher-frequency lines are amplified slightly with respect to lower-frequency lines prior to the noise level estimation. Applying the above nomenclature, N may be computed as by $N=\mathrm{sqrt}(\Sigma_{i\in A}(F_{left(i)}(i-\mathrm{left}(i))\cdot \mathrm{LPF}(i)^{-1}\cdot y_i)^2/\mathrm{cardinality}(A))$. As mentioned above, depending on the circumstances, the function LPF which corresponds to function 15 may have a positive slope and LPF changed to read HPF accordingly. It is briefly noted that in all above formulae using "LPF", setting $F_{left}$ to a constant function such as to be all one, would reveal a way how to apply the concept of subjecting the moise to be filled into the spectrum 34 with a spectrally global tilt without the tonality-dependent hole filling.

The possible computations of N may be performed in the encoder such as, for example, in 108 or 154.

Finally, it was found that when harmonics of a very tonal, stationary signal were quantized to zero, the lines representing these harmonics lead to a relatively high or unstable (i.e. time-fluctuating) noise level. This artifact can be reduced by using in the noise level calculation the average magnitude of zero-quantized lines instead of their RMS. While this alternative approach does not guarantee that the energy of the noise filled lines in the decoder reproduces the energy of the original lines in the noise filling regions, it does ensure that spectral peaks in the noise filling regions have only limited contribution to the overall noise level, thereby reducing the risk of overestimation of the noise level.

Finally, it is noted that an encoder may even be configured to perform the noise filling completely in order to keep itself in line with the decoder such as, for example, for analysis by synthesis purposes.

Thus, the above embodiment, inter alias, describes a signal adaptive method for replacing the zeros introduced in the quantization process with spectrally shaped noise. A noise filling extension for an encoder and a decoder are described that fulfill the abovementioned requirements by implementing the following:

- Noise filling start index may be adapted to the result of the spectrum quantization but limited to a certain range
- A spectral tilt may be introduced in the inserted noise to counteract the spectral tilt from the perceptual noise shaping
- All zero-quantized lines above the noise filling start index are replaced with noise
- By means of a transition function, the inserted noise is attenuated close to the spectral lines not quantized to zero
- The transition function is dependent on the instantaneous characteristics of the input signal
- The adaptation of the noise filling start index, the spectral tilt and the transition function may be based on the information available in the decoder There is no need for additional side information, except for a noise filling level Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] B. G. G. F. S. G. M. M. H. P. J. H. S. W. G. S. J. H. Nikolaus Rettelbach, "Noise Filler, Noise Filling Parameter Calculator Encoded Audio Signal Representation, Methods and Computer Program". Patent US 2011/0173012 A1.

[2] *Extended Adaptive Multi-Rate-Wideband (AMR-WB+) codec,* 3GPP TS 26.290 V6.3.0, 2005-2006.

[3] B. G. G. F. S. G. M. M. H. P. J. H. S. W. G. S. J. H. Nikolaus Rettelbach, "Audio encoder, audio decoder, methods for encoding and decoding an audio signal, audio stream and computer program". Patent WO 2010/003556 A1.

[4] M. M. N. R. G. F. J. R. J. L. S. W. S. B. S. D. C. H. R. L. P. G. B. B. J. L. K. K. H. Max Neuendorf, "MPEG Unified Speech and Audio Coding—The ISO/MPEG Standard for High-Efficiency Audio Coding of all Content Types," in 132*nd Convertion AES*, Budapest, 2012. Also appears in the Journal of the AES, vol. 61, 2013.

[5] M. M. M. N. a. R. G. Guillaume Fuchs, "MDCT-Based Coder for Highly Adaptive Speech and Audio Coding," in 17*th European Signal Processing Conference* (*EUSIPCO* 2009), Glasgow, 2009.

[6] H. Y. K. Y. M. T. Harada Noboru, "Coding Method, Decoding Method, Coding Device, Decoding Device, Program, and Recording Medium". Patent WO 2012/046685 A1.

The invention claimed is:

1. An audio decoder comprising:

a microprocessor or an electronic circuit configured to decode a spectrum of an audio signal from a data stream, perform noise filling on the spectrum of the audio signal in a manner dependent on a coding parameter signaled in the data stream to obtain a filled spectrum, and dequantize the filled spectrum, using a quantization step size with varying the quantization step size according to a linear prediction spectral envelope signaled in the data stream via one of linear prediction coefficients and scale factors of scale factor bands, wherein the decoder is configured to perform the noise filling by filling a contiguous spectral zero-portion of the audio signal's spectrum with noise spectrally shaped by one of using a function assuming a maximum in an inner of the contiguous spectral zero-portion, and comprising outwardly falling edges an absolute slope of which negatively depends on the coding parameter, using a function assuming a maximum in an inner of the contiguous spectral zero-portion, and comprising outwardly falling edges a spectral width of which positively depends on the coding parameter, and using a function a ratio between a first integral of which over outer quarters of the contiguous spectral zero-portion and a second integral of which over the outer quarters and inner quarters of the contiguous spectral zero-portion depends on the coding parameter, wherein the coding parameter is one of an LTP (long-term prediction) flag or gain, a TNS (temporal noise shaping) enablement flag or gain, and a spectrum rearrangement enablement flag signalling a coding option according to which quantized spectral values are spectrally re-arranged with additionally transmitting within the data stream the rearrangement prescription.

2. The audio decoder according to claim 1, configured to scale the noise with which the contiguous spectral zero-portion is filled using a scalar global noise level signaled in the data stream.

3. The audio decoder according to claim 1, apparatus is configured to generate the noise using a random or pseudo-random process or using patching.

4. The audio decoder according to claim 1, configured to confine the performance of the noise filling onto a high-frequency spectral portion of the audio signal's spectrum.

5. The audio decoder according to claim 4 configured to set a low-frequency starting position of the high-frequency spectral portion corresponding to an explicit signaling in the data stream.

6. The audio decoder according to claim 1, configured to, in performing the noise filling, fill contiguous spectral zero-portions of the spectrum with noise a level of which exhibits a decrease from low to high frequencies, approximating a spectral low-pass filter's transfer function so as to counteract a spectral tilt caused by a pre-emphasis used to code the audio signal's spectrum.

7. The audio decoder according to claim 6, the apparatus is configured to adapt a steepness of the decrease to a pre-emphasis factor of the pre-emphasis.

8. An audio encoder comprising:

a microprocessor or electronic circuit configured to quantize and code a spectrum of an audio signal into a data stream using a quantization step size with varying the quantization step size depending a linear prediction spectral envelope, signaled, in the data stream, information on the linear prediction spectral envelope via one of linear prediction coefficients and scale factors of scale factor bands, and set and code, into the data stream, a spectrally global noise filling level for performing noise filling on the spectrum of the audio signal, by a coding parameter signaled in the data stream, a contiguous spectral zero-portion of the audio signal's spectrum by one of using a function assuming a maximum in an inner of the contiguous spectral zero-portion, and comprising outwardly falling edges an absolute slope of which negatively depends on the coding parameter, using a function assuming a maximum in an inner of the contiguous spectral zero-portion, and comprising outwardly falling edges a spectral width of which positively depends on the coding parameter, and a function a ratio between a first integral of which over outer quarters of the contiguous spectral zero-portion and a second integral of which over the outer quarters and inner quarters of the contiguous spectral zero-portion depends on the coding parameter, to obtain a shaped portion of the audio signal's spectrum, and measuring a level of the shaped portion of the audio signal's spectrum, wherein the coding parameter is one of an LTP (long-term prediction) flag or gain, a TNS (temporal noise shaping) enablement flag or gain, and a spectrum rearrangement enablement flag signalling a coding option according to which quantized spectral values are spectrally re-arranged with additionally transmitting within the data stream the rearrangement prescription.

9. The audio encoder according to claim 8, wherein the measure is a root mean square.

10. A method for audio decoding comprising:

decoding a spectrum of an audio signal from a data stream, performing noise filling on the spectrum of the audio signal in a manner dependent on a coding parameter signaled in the data stream to obtain a filled spectrum, and dequantizing the filled spectrum using a quantization step size with varying the quantization step size according to a linear prediction spectral envelope signaled in the data stream via one of linear prediction coefficients and scale factors of scale factor bands wherein the noise filling is performed by filling a contiguous spectral zero-portion of the audio signal's spectrum with noise spectrally shaped by one of using a function assuming a maximum in an inner of the contiguous spectral zero-portion, and comprising outwardly falling edges an absolute slope of which negatively depends on the coding parameter, using a function assuming a maximum in an inner of the contiguous spectral zero-portion, and comprising outwardly falling edges a spectral width of which positively depends on the coding parameter, and using a function a ratio between a first integral of which over outer quarters of the contiguous spectral zero-portion and a second integral of which over the outer quarters and inner quarters of the contiguous spectral zero-portion depends on the coding parameter, wherein the coding parameter is on of an LTP (long-term prediction) flag or gain, a TNS (temporal noise shaping) enablement flag or gain, and a spectrum rearrangement enablement flag signaling a coding option according to which quantized spectral values are spectrally re-arranged with additionally transmitting within the data stream the rearrangement prescription.

11. A method for audio encoding, comprising:

quantizing and coding a spectrum of an audio signal into a data stream using a quantization step size with varying the quantization step size depending a linear prediction spectral envelope, signaled, in the data stream, information on the linear prediction spectral envelope via one of linear prediction coefficients and scale factors of scale factor bands, and setting and coding, into the data stream, a spectrally global noise filling level for performing noise filling on the spectrum of the audio signal, by spectrally shaping, dependent on a coding parameter signaled in the data stream, a contiguous spectral zero-portion of the audio signal's spectrum by one of using a function assuming a maximum in an inner of the contiguous spectral zero-portion, and comprising outwardly falling edges an absolute slope of which negatively depends on the coding parameter, using a function assuming a maximum in an inner of the contiguous spectral zero-portion, and comprising outwardly falling edges a spectral width of which positively depends on the coding parameter, and a function a ratio between a first integral of which over outer quarters of the contiguous spectral zero-portion and a second integral of which over the outer quarters and inner quarters of the contiguous spectral zero-portion depends on the coding parameter, to obtain a shaped portion of the audio signal's spectrum, and measuring a level of the shaped portion of the audio signal's spectrum, wherein the coding parameter is one of an LTP (long-term prediction) flag or gain, a TNS (temporal noise shaping) enablement flag or gain, and a spectrum rearrangement enablement flag signalling a coding option according to which quantized spectral values are spectrally re-arranged with additionally transmitting within the data stream the rearrangement prescription.

12. A non-transitory computer-readable storage medium storing a computer program comprising a program code for performing, when running on a computer, a method for audio decoding, comprising:

decoding a spectrum of an audio signal from a data stream, performing noise filling on the spectrum of the audio signal in a manner dependent on a coding parameter signaled in the data stream to obtain a filled spectrum, dequantizing the filled spectrum using a quantization step size with varying the quantization step size according to a linear prediction spectral envelope signaled in the data stream via one of linear prediction coefficients and scale factors of scale factor bands, wherein the noise filling is performed by filling a contiguous spectral zero-portion of the audio signal's spectrum with noise spectrally shaped by one of using a function assuming a maximum in an inner of the contiguous spectral zero-portion, and comprising outwardly falling edges an absolute slope of which negatively depends on the coding parameter, or using a function assuming a maximum in an inner of the contiguous spectral zero-portion, and comprising outwardly falling edges a spectral width of which positively depends on the coding parameter, or using a function a ratio between a first integral of which over outer quarters of the contiguous spectral zero-portion and a second integral of which over the outer quarters and inner quarters of the contiguous spectral zero-portion depends on the coding parameter, wherein the coding parameter is one of an LTP (long-term prediction) flag or gain, a TNS (temporal noise shaping) enablement flag or gain, and a spectrum rearrangement enablement flag signalling a coding option according to which quantized spectral values are spectrally re-arranged with additionally transmitting within the data stream the rearrangement prescription, when said computer program is run by a computer.

13. A non-transitory computer-readable storage medium storing computer program comprising a program code for performing, when running on a computer, a method for audio encoding, comprising:

quantizing and coding a spectrum of an audio signal into a data stream using a quantization step size with varying the quantization step size depending a linear prediction spectral envelope, signaled, in the data stream, information on the linear prediction spectral envelope via one of linear prediction coefficients and scale factors of scale factor bands, and setting and coding, into the data stream, a spectrally global noise filling level for performing noise filling on the spectrum of the audio signal, by spectrally shaping, dependent on a coding parameter signaled in the data stream, a contiguous spectral zero-portions of the audio signal's spectrum by one of using a function assuming a maximum in an inner of the contiguous spectral zero-portion, and comprising outwardly falling edges an absolute slope of which negatively depends on the coding parameter, using a function assuming a maximum in an inner of the contiguous spectral zero-portion, and comprising outwardly falling edges a spectral width of which positively depends on the coding parameter, and a function a ratio between a first integral of which over outer quarters of the contiguous spectral zero-portion negatively and a second integral of which over the outer quarters and inner quarters of the contiguous spectral zero-portion depends on the coding parameter, to obtain a shaped portion of the audio signal's spectrum, and measuring a level of the shaped portion of the audio signal's spectrum, wherein the coding parameter is one of an LTP (long-term prediction) flag or gain, a TNS (temporal noise shaping) enablement flag or gain, and a spectrum rearrangement enablement flag signalling a coding option according to which quantized spectral values are spectrally re-arranged with additionally transmitting within the data stream the rearrangement prescription, when said computer program is run by a computer.

* * * * *